US009256165B2

(12) United States Patent
Takahashi et al.

(10) Patent No.: US 9,256,165 B2
(45) Date of Patent: Feb. 9, 2016

(54) TRANSFER DEVICE AND IMAGE FORMING APPARATUS INCORPORATING SAME

(71) Applicants: Yasufumi Takahashi, Kanagawa (JP); Osamu Ichihashi, Kanagawa (JP); Yuji Kato, Kanagawa (JP); Junpei Fujita, Kanagawa (JP)

(72) Inventors: Yasufumi Takahashi, Kanagawa (JP); Osamu Ichihashi, Kanagawa (JP); Yuji Kato, Kanagawa (JP); Junpei Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/272,810

(22) Filed: May 8, 2014

(65) Prior Publication Data

US 2014/0334847 A1 Nov. 13, 2014

(30) Foreign Application Priority Data

May 9, 2013 (JP) ..... 2013-099624

(51) Int. Cl.
*G03G 15/08* (2006.01)
*G03G 15/16* (2006.01)

(52) U.S. Cl.
CPC .... *G03G 15/1605* (2013.01); *G03G 2215/0129* (2013.01)

(58) Field of Classification Search
USPC ..... 399/121, 313
See application file for complete search history.

(56) References Cited

U.S. PATENT DOCUMENTS

| | | | |
|---|---|---|---|
| 2009/0279927 | A1 | 11/2009 | Fujita |
| 2010/0067952 | A1 | 3/2010 | Fujita et al. |
| 2010/0142985 | A1 | 6/2010 | Minbe et al. |
| 2010/0221029 | A1 | 9/2010 | Minbu et al. |
| 2010/0272478 | A1 | 10/2010 | Ichihashi |
| 2011/0064487 | A1 | 3/2011 | Ichihashi et al. |
| 2011/0158690 | A1 | 6/2011 | Mimbu et al. |
| 2011/0206399 | A1 | 8/2011 | Fujita et al. |
| 2011/0286759 | A1 | 11/2011 | Ichihashi et al. |
| 2011/0293312 | A1 | 12/2011 | Mimbu et al. |
| 2012/0121293 | A1 | 5/2012 | Mimbu et al. |
| 2012/0148300 | A1 | 6/2012 | Katoh et al. |
| 2012/0200871 | A1 | 8/2012 | Takahashi et al. |
| 2012/0224879 | A1 | 9/2012 | Fujita et al. |
| 2012/0237233 | A1 | 9/2012 | Kato et al. |
| 2012/0237260 | A1 | 9/2012 | Sengoku et al. |
| 2012/0308250 | A1 | 12/2012 | Shimizu et al. |

(Continued)

FOREIGN PATENT DOCUMENTS

| | | |
|---|---|---|
| JP | 2010-133653 | 6/2010 |
| JP | 2010-134142 | 6/2010 |

(Continued)

*Primary Examiner* — Clayton E Laballe
*Assistant Examiner* — Minh Phan
(74) *Attorney, Agent, or Firm* — Harness, Dickey & Pierce, P.L.C.

(57) ABSTRACT

A transfer device includes an image carrier, a transfer roller, and a moving unit. The moving unit moves the transfer roller between a nip formation state in which the transfer roller forms a transfer nipping portion in contact with the image carrier and a separated state in which the transfer roller is separated from the image carrier. In a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation. The moving unit causes the recording medium to enter the transfer nipping portion in the contact operation.

17 Claims, 15 Drawing Sheets

(56) References Cited

U.S. PATENT DOCUMENTS

| | | | |
|---|---|---|---|
| 2012/0315058 | A1 | 12/2012 | Shimizu et al. |
| 2012/0328315 | A1 | 12/2012 | Takeuchi et al. |
| 2012/0328320 | A1 | 12/2012 | Fujita et al. |
| 2012/0328321 | A1 | 12/2012 | Takeuchi et al. |
| 2013/0004190 | A1 | 1/2013 | Sengoku et al. |
| 2013/0016989 | A1 | 1/2013 | Fujita et al. |
| 2013/0114982 | A1 | 5/2013 | Ichihashi et al. |
| 2013/0189002 | A1 | 7/2013 | Ichihashi et al. |
| 2013/0223901 | A1 | 8/2013 | Minbe et al. |
| 2013/0243482 | A1 | 9/2013 | Kato et al. |
| 2013/0322935 | A1 | 12/2013 | Ichihashi et al. |
| 2014/0016970 | A1 | 1/2014 | Ichihashi |
| 2014/0072340 | A1 | 3/2014 | Kato et al. |

FOREIGN PATENT DOCUMENTS

| | | |
|---|---|---|
| JP | 2010-139603 | 6/2010 |
| JP | 2011-133653 | 7/2011 |

TRANSFER DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-099624, filed on May 9, 2013, in the Japan Patent Office, the entire disclosure of which is hereby incorporated by reference herein.

BACKGROUND

1. Technical Field

Exemplary embodiments of this disclosure relate to a transfer device incorporated in an electrophotographic image forming apparatus such as a copier, a printer, a facsimile machine, or a multi-functional device having at least one of the foregoing capabilities, and an electrophotographic image forming apparatus incorporating the transfer device.

2. Description of the Related Art

Conventionally, among color electrophotographic image forming apparatuses, there have been widely used an apparatus including a transfer device that transfers, onto a recording medium, toner images carried on a plurality of photoconductors and image carriers such as intermediate transfer bodies, for the purpose of high image quality and high reliability.

In a configuration using an intermediate transfer member, the transfer device secondarily transfers a toner image carried on the intermediate transfer member onto a recording medium by applying a secondary transfer bias when the recording medium passes through between the intermediate transfer member and a secondary transfer roller, in a state of a predetermined nipping pressure being generated in a secondary transfer nipping portion formed by the intermediate transfer member and the secondary transfer roller. On the other hand, when a secondary transfer is not performed in a waiting time of the image forming apparatus and in an adjustment operation inside the image forming apparatus, the secondary transfer roller is moved to be separated from the intermediate transfer member in order to prevent deterioration of the transfer device having the intermediate transfer member and the secondary transfer roller. There has been conventionally known a transfer device having a moving unit which moves (contacts and separates) the secondary transfer roller to a state of the secondary transfer nipping portion being formed by abutting the secondary transfer roller against the intermediate transfer member and a state of the intermediate transfer member and the secondary transfer nipping portion being separated.

For example, an image forming apparatus includes a transfer device (secondary transfer device) having the following moving unit (contact-and-separation unit) that moves the secondary transfer roller so that an intermediate transfer belt as a belt-shaped intermediate transfer member and the secondary transfer roller are contacted and separated. The moving unit includes a biasing unit that biases the secondary transfer roller toward the intermediate transfer belt, and cams that move the secondary transfer roller so that the secondary transfer roller is separated from the intermediate transfer belt against the bias force of the biasing unit and that the secondary transfer roller is brought into contact with the intermediate transfer belt by the bias force of the biasing unit. The cams are plate cams provided in a rotary shaft that rotatably supports a secondary-transfer opposing roller that opposes the secondary transfer roller via the intermediate transfer belt. A distance between an outer circumferential surface of each cam at a position where the cam opposes or is in contact with a follower (roller) provided on the rotary shaft of the secondary transfer roller and a rotation center of the cam (hereinafter, referred to as a "cam radius") is changed by rotation so that a position of the follower in contact with the cam is moved. By moving the follower in this way, the secondary transfer roller is moved by changing an inter-axis distance between the secondary transfer roller and the secondary-transfer opposing roller.

On an outer circumferential surface of the cams, the following three kinds of regions are formed. A cam radius opposing the follower presses the follower against the bias force of the biasing unit, and is formed in a predetermined cam radius in which the intermediate transfer belt and the secondary transfer roller separate from each other, and the cam radius becomes in contact with the follower. This is a first region. The cam radius is formed in a predetermined cam radius in which the intermediate transfer belt and the secondary transfer roller are abutted against each other by the bias force of the biasing unit, and the cam radius is separated from the follower. This is a second region. The cam radius changes between the first region where the cam radius is in a state of being in contact with the follower and the second region where the cam radius is in a state of being separated from the follower. This is a third region. The moving unit changes the cam radius on the outer circumferential surface opposing the follower by rotating the cam configured as described above, moves the secondary transfer roller by changing the inter-axis distance between the secondary transfer roller and the secondary-transfer opposing roller, and contacts and separates the intermediate transfer belt and the secondary transfer roller.

Before a front end of the recording medium enters the secondary transfer nipping portion formed by the intermediate transfer belt and the secondary transfer roller, rotation of the cam for changing the outer circumferential surface opposing the follower from the first region to the second region is started at a certain angular velocity (velocity). After rotation starts, the angular velocity of the cam is accelerated to a target angular velocity by the time when the front end of the recording medium enters the secondary transfer nipping portion. Thereafter, the target angular velocity is maintained, and the front end of the recording medium enters the secondary transfer nipping portion in a state that the outer circumferential surface of the cam opposing the follower is in a state of being in the first region. By the rotation at the target angular velocity of the cam that changes the outer circumferential surface opposing the follower from the first region to the second region, the outer circumferential surface opposing the follower reaches the change region. Then, the inter-axis distance between the secondary transfer roller and the secondary-transfer opposing roller starts becoming short. When the inter-axis distance becomes shorter in this way, the intermediate transfer belt and the secondary transfer roller are abutted against each other via the recording medium, and a nipping pressure starts being generated in the secondary transfer nipping portion. Thereafter, the rotation of the cam at the target angular velocity is continued, and the secondary transfer roller moves toward the intermediate transfer belt to a position of generating a nipping pressure at which clear aggravation of a secondary transfer is not observed (hereinafter, referred to as "necessary nipping-pressure position"). Thereafter, a front end of the image-forming region of the recording medium enters the secondary transfer nipping portion.

In this way, the nipping pressure is generated in the secondary transfer nipping portion after the front end of the recording medium enters the secondary transfer nipping portion. Therefore, a rapid increase in the nipping pressure generated when a cardboard enters can be reduced more than that in a transfer device that makes the recording medium enter secondary transfer nipping portion in a state of the nipping pressure being generated. Before the front end of the image-forming region of the recording medium enters the secondary transfer nipping portion, the secondary transfer roller can be moved toward the intermediate transfer belt to the necessary nipping-pressure position. Therefore, by reducing a rapid increase in the nipping pressure generated when a cardboard enters more than an increase in a transfer device that makes the recording medium enter the secondary transfer nipping portion in a state of the nipping pressure being generated, generation of shock jitter can be suppressed and image quality reduction attributable to a transfer pressure shortage can be suppressed.

In recent years, there has been a growing demand by users for higher image quality in the image forming apparatus. Therefore, the transfer device that secondarily transfers a toner image on the intermediate transfer member after performing the primary transfer, to the recording medium, is also required to further enhance the suppression effect of suppressing image quality reduction such as shock jitter when making a cardboard and the like enter the secondary transfer nipping portion.

BRIEF SUMMARY

In at least one exemplary embodiment of this disclosure, there is provided a transfer device including an image carrier, a transfer roller, and a moving unit. The image carrier carries a toner image thereon. The transfer roller forms a transfer nipping portion in contact with the image carrier and transfers the toner image carried on the image carrier onto a recording medium entering the transfer nipping portion. The moving unit moves the transfer roller between a nip formation state in which the transfer roller forms the transfer nipping portion in contact with the image carrier and a separated state in which the transfer roller is separated from the image carrier. In a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation. The moving unit causes the recording medium to enter the transfer nipping portion in the contact operation.

In at least one exemplary embodiment of this disclosure, there is provided an image forming apparatus including a transfer device. The transfer device including an image carrier, a transfer roller, and a moving unit. The image carrier carries a toner image thereon. The transfer roller forms a transfer nipping portion in contact with the image carrier and transfers the toner image carried on the image carrier onto a recording medium entering the transfer nipping portion. The moving unit moves the transfer roller between a nip formation state in which the transfer roller forms the transfer nipping portion in contact with the image carrier and a separated state in which the transfer roller is separated from the image carrier. In a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation. The moving unit causes the recording medium to enter the transfer nipping portion in the contact operation.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
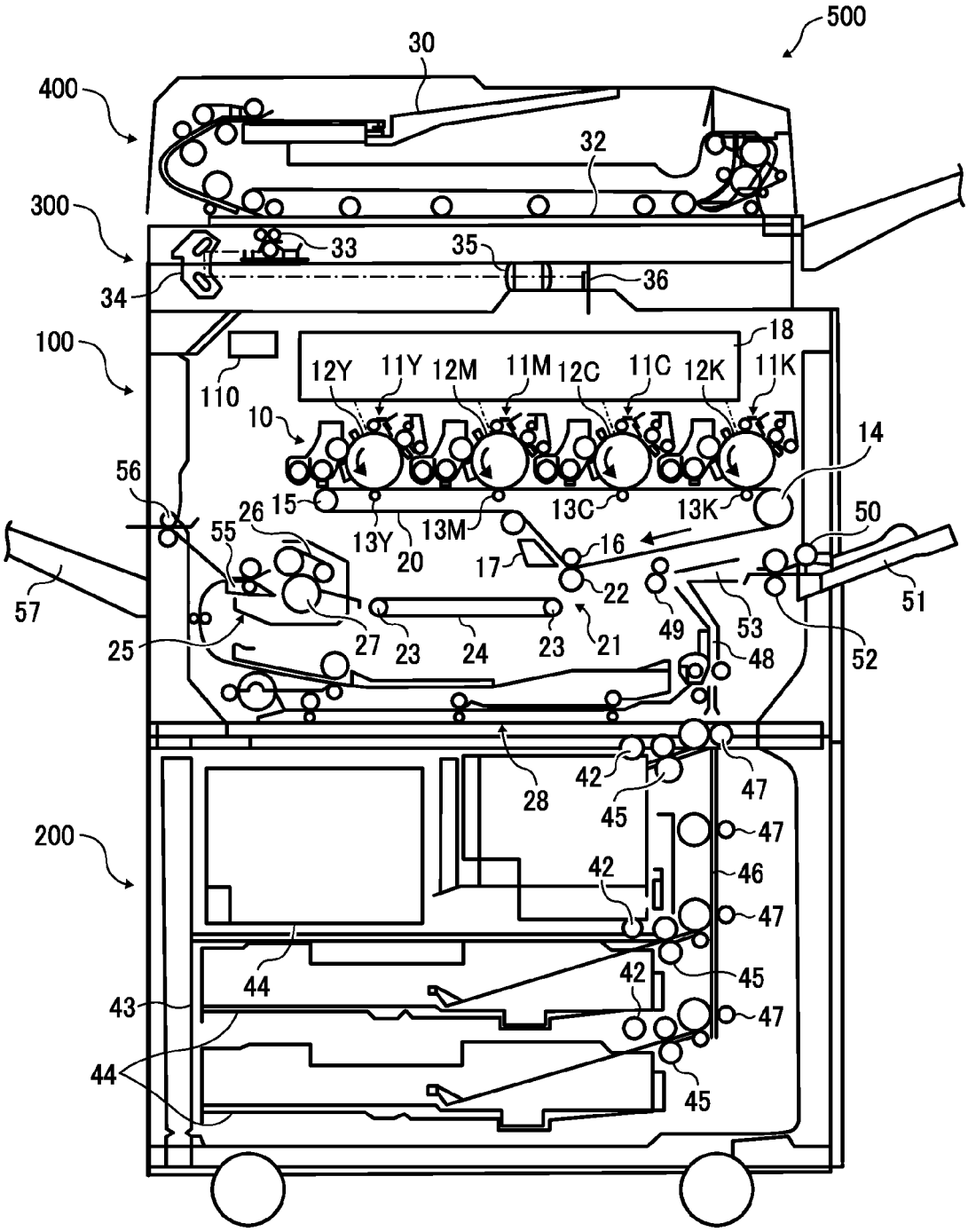
FIG. 1 is a schematic view of a configuration of an image forming apparatus according to Embodiment 1.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

As described above, in recent years, there has been a growing demand by users for higher image quality in the image forming apparatus. Therefore, the transfer device that secondarily transfers a toner image on the intermediate transfer member after performing the primary transfer, to the recording medium, is also required to further enhance the suppression effect of suppressing image quality reduction such as shock jitter when making a cardboard and the like enter the secondary transfer nipping portion.

However, for the above-described configuration, for the following reason, the suppression effect may not be enhanced of suppressing image quality reduction such as shock jitter when a cardboard and the like enter the secondary transfer nipping portion. The angular velocity of the cam is constant at a target angular velocity, for both at the operation time of start generating the nipping pressure in the secondary transfer nipping portion by abutting the intermediate transfer belt and the secondary transfer roller against each other, and at a subsequent pressing operation of moving the secondary transfer roller toward the intermediate transfer belt to the necessary nipping-pressure position. The moving velocities of the secondary transfer roller in these operations are considered to be substantially constant, because a time change of the cam radius and the angular velocity of the cam described in the timing chart corresponding to the above-described configuration are constant.

In the timing chart, there is described an example that the timing when the outer circumferential surface of the cam opposing the follower reaches the change region from the first region and the timing when the nipping pressure starts being generated are the same. That is, there is described an example that a distance between the intermediate transfer belt and the secondary transfer roller when the first region of the outer circumferential surface opposes the follower and the cam pressurizes the follower is the same as a thickness of the recording medium such as the cardboard. On the other hand, a thickness of the recording medium such as the cardboard in which image quality reduction such as shock jitter occurs is not limited to a distance in which the outer circumferential surface of the cam opposes the follower in the first region and separates the intermediate transfer belt and the secondary transfer roller from each other. Therefore, when a cardboard thinner than the distance between the intermediate transfer belt and the secondary transfer roller enters when the outer circumferential surface of the cam opposes the follower in the first region, the operation of start generating a nipping pressure in the secondary transfer nipping portion from a separated state can be broadly divided into the following two operations. These are an approaching operation of making the secondary transfer roller approach the intermediate transfer belt, and a contact operation of start generating the nipping pressure by bringing the secondary transfer roller and the intermediate transfer belt into contact with each other.

At least the contact operation and the pressing operation need to be completed by the time when the image-forming region on the recording medium enters the secondary transfer nipping portion after the recording medium enters the secondary transfer nipping portion. However, the moving velocities of the secondary transfer roller in the approaching operation, the contact operation, and the approaching operation are constant. Therefore, when the velocity of the recording medium entering the secondary transfer nipping portion, that is, the sheet-conveyance velocity becomes fast, the secondary-transfer roller moving velocity needs to be set fast in the contact operation and the pressing operation, in proportion to the sheet-conveyance velocity. When the secondary-transfer roller moving velocity toward the intermediate transfer belt in the contact operation is set fast, the impact when the secondary transfer roller is abutted against the intermediate transfer belt via the recording medium becomes large.

When the impact generated in the secondary transfer nipping portion becomes too large, oscillation attributable to the impact occurs in the intermediate transfer belt and the secondary transfer roller. The oscillation might produce an adverse effect on the secondary transfer without being converged before the image-forming region of the recording medium enters the secondary transfer nipping portion, or might be spread to the image carrier such as a photoconductor via the intermediate transfer belt and producing an adverse effect on the primary transfer from the image carrier to the intermediate transfer member. When an adverse effect occurs in the secondary transfer or the primary transfer, it becomes difficult to further enhance the suppression effect of suppressing image quality reduction such as shock jitter when a cardboard and the like pass through.

There is also a similar problem in an apparatus called a direct-transfer-system image forming apparatus that includes an image carrier such as a photoconductor carrying a toner image on the surface and the transfer roller, and that transfers the toner image carried on the image carrier to the recording medium which enters the transfer nipping portion between the image carrier and the transfer roller. In this case, oscillation occurs in the image carrier such as the photoconductor, and the transfer roller. The oscillation might produce an adverse effect on the transfer without being converged before the image-forming region of the recording medium enters the transfer nipping portion, or might be spread to the development unit, the charging unit, and the exposing unit on the image carrier and produce an adverse effect on the image forming operation.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

[Embodiment 1] Hereinafter, an image forming apparatus according to a first embodiment (hereinafter, referred to as "Embodiment 1") of the present disclosure will be described FIG. 1 is a schematic view of a configuration of an image forming apparatus 500 according to Embodiment 1. In FIG. 1, the image forming apparatus 500 is illustrated as a copier. However, the image forming apparatus according to other embodiments is not limited to the copier but may be any other suitable image forming apparatus.

In FIG. 1. the image forming apparatus 500 is mainly configured by an apparatus body 100, a sheet feed table 200 on which the apparatus body 100 is mounted, a scanner 300 fitted on the apparatus body 100, and an auto document feeder (ADF) 400 fitted on the scanner 300.

The scanner 300 performs a reading-scanning of a document not shown mounted on an exposure glass 32, following a reciprocal movement of a first traveling body 33 on which a document illumination light source, a mirror, and the like are mounted, and a second traveling body 34 on which a plurality of reflection mirrors are mounted. Scanning light transmitted from the second traveling body 34 is focused by an imaging lens 35 onto an imaging surface of a reading sensor 36 set behind the imaging lens 35. Thereafter, the reading sensor 36 reads the focused scanning light as an image signal.

A tandem-type image forming section 10 is arranged on the apparatus body 100. The tandem-type image forming section 10 includes image forming units 11Y, 11C, 11M, and 11K corresponding to toners of yellow, cyan, magenta, and black colors. Each image-forming unit motor shaft 11 is provided with photoconductor drums 12Y, 12C, 12M, and 12K as image carriers carrying a toner image obtained by a development device that changes an electrostatic latent image formed on the photoconductor drums into the toner image. Around each photoconductor drum 12, there are provided various units that execute an electrophotographic process, such as a charging device that uniformly charges the photoconductor drum, a development device that develops a latent image on the photoconductor drum, and a photoconductor cleaning device that removes a residual toner on the photoconductor drum.

On the tandem-type image forming section 10, there is provided an exposure device 18 that forms a latent image by exposing the photoconductor drum 12 with a laser beam or an LED light based on image information.

At a lower position of the tandem-type image forming section 10 opposing each photoconductor drum 12, there is arranged an intermediate transfer belt 20 as an intermediate transfer member that is formed of an endless belt member and that is an image carrier carrying a toner image sequentially primarily transferred from each photoconductor drum 12. The intermediate transfer belt 20 is supported by support rollers 14 and 15 and a secondary-transfer opposing roller 16 as a support roller, and is conveyed in a clockwise direction in FIG. 1 at an image forming time. On a tensioned surface of the intermediate transfer belt 20 tensioned between the support roller 14 and the support roller 15, there are laterally arranged the image forming units 11Y, 11C, 11M, and 11K in the order of yellow, cyan, magenta, and black from an upstream side along a moving direction of the intermediate transfer belt 20. At an adjacent position opposing each photoconductor drum 12 via the intermediate transfer belt 20, there is arranged a primary transfer roller 13 as a transfer roller configuring a transfer unit which transfers a toner image of each color formed on each photoconductor drum 12 onto the intermediate transfer belt 20. On the intermediate transfer belt 20, a cleaning device 17 that removes a toner remaining on the intermediate transfer belt 20 is provided on a downstream side (left side in FIG. 1) of the moving direction of the intermediate transfer belt 20 supported by the secondary-transfer opposing roller 16.

On the opposite side of the tandem-type image forming section 10 sandwiching the intermediate transfer belt 20, there is arranged a secondary transfer device 21 as a transfer device which collectively transfers toner images formed in superposition on the surface of the intermediate transfer belt 20 onto a sheet P (not shown in FIG. 1) as a recording medium. The secondary transfer device 21 mainly includes the secondary-transfer opposing roller 16, a secondary transfer roller 22 as a transfer roller that is abutted against the secondary-transfer opposing roller 16 via the intermediate transfer belt 20, and a moving unit that moves the secondary transfer roller 22 described in detail later to the intermediate transfer belt 20. The moving unit can move the secondary transfer roller 22 to the intermediate transfer belt 20 so as to be contacted to and separated from the intermediate transfer belt 20. The secondary transfer device 21 sandwiches the sheet P conveyed from a sheet feed cassette 44 of the sheet feed table 200, by a secondary transfer nipping portion as a transfer nipping portion formed so that the secondary transfer roller 22 abuts against the intermediate transfer belt 20 by using the moving unit. By applying a secondary transfer pressure and a secondary transfer bias to the sheet P sandwiched by the secondary transfer nipping portion in this way, the toner image carried on the intermediate transfer belt 20 is transferred to the sheet P.

At a position adjacent to a downstream side (left side in FIG. 1) of the sheet conveyance direction of the secondary transfer roller 22, there is provided a belt conveyance device configured by two tension rollers 23 and a conveyance belt 24 tensioned on the tension rollers 23, to convey the secondarily-transferred sheet P. At a position adjacent to a downstream side (left side in FIG. 1) of the sheet conveyance direction of the conveyance belt 24, there is provided a fixing device 25. The fixing device 25 fixes the toner image on the sheet P conveyed by the conveyance belt 24. The fixing device 25 is mainly configured by a fixing belt 26 as an endless belt, and a pressing roller 27 which is pressed against the fixing belt 26. Below the secondary transfer device 21 and the fixing device 25, there is arranged, in parallel with the tandem-type image forming section 10, a sheet reverse device 28 that reverses the sheet P to record an image on both surfaces of the sheet P.

A color copy operation of the image forming apparatus 500 having the above configuration will be described below. First, a document is set on the document table 30 of the auto document feeder 400 shown in FIG. 1. Alternatively, the auto document feeder 400 is opened, the document is set on the exposure glass 32 of the scanner 300, and the document is pressed by closing the auto document feeder 400. In this state, a starting switch not shown is pressed. When the document is set on the auto document feeder 400, the auto document feeder 400 conveys the document onto the exposure glass 32, and then, the scanner 300 is driven. On the other hand, when the document is set on the exposure glass 32, the scanner 300 is driven immediately. Then, the first traveling body 33 and the second traveling body 34 are operated. The first traveling body 33 emits light from the light source, and receives reflection light from the document surface. The first traveling body 33 reflects the received reflection light to the second traveling body 34. The second traveling body 34 further reflects the reflection light by a mirror thereof. The reflected light enters the reading sensor 36 through the imaging lens 35. The reading sensor 36 reads the document content.

By pressing the starting switch, the driving motor is driven to rotation-drive one of the support rollers 14 and 15 and the secondary-transfer opposing roller 16 that also functions as a support roller. The other two support rollers are driven subordinately, so that the intermediate transfer belt 20 is rotation-conveyed. At the same time, in each image forming unit 11, rotations of respective photoconductor drums 12 are started. The charging device uniformly charges the photoconductor drum 12. Based on the contents read by the scanner 300, the exposure device 18 irradiates each photoconductor drum 12 with writing light L such as a laser beam or an LED. On the photoconductor drum 12 that is charged, an electrostatic latent image corresponding to each of yellow, cyan, magenta, and block is formed. The development device supplies a toner to each photoconductor drum 12 on which the electrostatic latent image is formed. The electrostatic latent image is made as a visible image. On each photoconductor drum 12, a toner image corresponding to a single color of each of yellow, cyan, magenta, and block is formed.

Toner images each in a single color are sequentially primarily transferred in superimposition onto the intermediate transfer belt 20 by a primary transfer bias applied by each primary transfer roller 13, and a combined color toner image is formed on the intermediate transfer belt 20. The photoconductor cleaning device removes the residual toner from the surface of each photoconductor drum 12 after the primary transfer. The charge-neutralizing device neutralizes the surface, and prepares for the next image forming.

By pressing the starting switch, one of sheet feed rollers 42 of the sheet feed table 200 is selectively rotated. The sheet P is taken out from one of the sheet feed cassettes 44 provided in a multistage in the paper bank 43. A separation roller 45 separates each sheet P and guides the sheet P to a sheet feed path 46. The sheet P guided to the sheet feed path 46 is conveyed by a conveyance roller 47 to a sheet feed path 48 in the apparatus body 100, and is stopped by being abutted against a registration roller 49. On the other hand, in the case of manually inserting the sheet P, a sheet feed roller 50 is rotated to take out the sheet P from a bypass tray 51. A separation roller 52 separates each sheet P, and guides the sheet P to a sheet feed path 53. The sheet P is stopped by being abutted against the registration roller 49 in a similar manner to that of taking out the sheet from the sheet feed cassette 44. The registration roller 49 is rotated at timing with a color toner image combined on the intermediate transfer belt 20. The sheet is fed into between the intermediate transfer belt 20 and the secondary transfer roller 22. The secondary transfer device 21 transfers the color toner image onto the sheet P.

The sheet P carrying an unfixed toner image after passing through the secondary transfer nipping portion formed by the intermediate transfer belt 20 and the secondary transfer roller 22 is conveyed to the fixing device 25 by a belt conveyance device configured by the two tension rollers 23 and the conveyance belt 24. The fixing device 25 fixes, as a permanent image, the toner image transferred onto the sheet P by adding heat and a pressure.

A switching tab 55 switches a conveyance destination of the sheet P after the toner image is fixed. A discharge roller 56 discharges the sheet P to be stacked on a sheet discharge tray 57. On the other hand, in the case of both-side copying, the switching tab 55 switches a conveyance destination of the sheet P after an image is formed on one side of the sheet P. The sheet P is guided to the sheet reverse device 28. The sheet reverse device 28 reverses the sheet P, and guides the sheet P to a transfer position again, so that an image is also formed on the rear side of the sheet P. Thereafter, the discharge roller 56 discharges the sheet P to be stacked on a sheet discharge tray 57. At this time, the cleaning device 17 removes the residual toner remaining on the intermediate transfer belt 20 after the secondary transfer, to prepare for the next image to be formed by the tandem-type image forming section 10. Next, there will be described a plurality of examples of the secondary transfer device 21 as a transfer device having a moving unit that moves the secondary transfer roller 22 to contact to and separate from the intermediate transfer belt 20, as a characteristic portion of the image forming apparatus 500 according to Embodiment 1.

EXAMPLE 1

Figure 2:
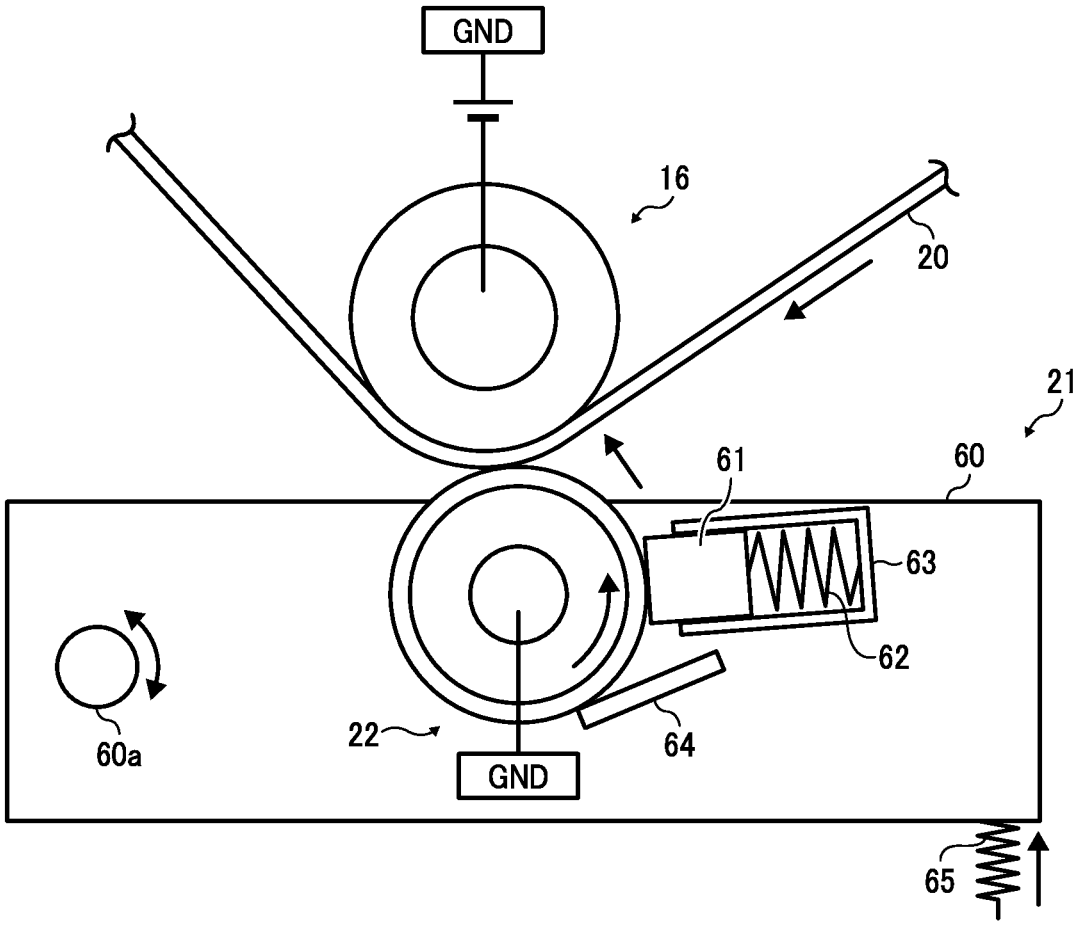
FIG. 2 is a view of a secondary transfer device and a surrounding configuration thereof according to Example 1.

First, Example 1 of the secondary transfer device 21 according to Embodiment 1 will be described with reference to drawings. FIG. 2 is a view of the secondary transfer device 21 and a surrounding configuration of the secondary transfer device 21 in the apparatus body 100 according to Example 1. In FIG. 2, the secondary-transfer opposing roller 16 has the intermediate transfer belt 20 partly wound around the own circumferential surface on an inner circumferential surface side of the intermediate transfer belt 20. The secondary-transfer opposing roller 16 has a role of maintaining the intermediate transfer belt 20, which is deformable, in a shape along a constant curvature by backing up the intermediate transfer belt 20 on the circumferential surface of the secondary-transfer opposing roller 16. At the portion where the intermediate transfer belt 20 is wound around the secondary-transfer opposing roller 16, the secondary transfer roller 22 is abutted against on the outer circumferential surface side of the intermediate transfer belt 20, so that the secondary transfer nipping portion is formed.

The secondary transfer roller 22 is rotatably held by a roller unit holder 60 via a bearing. The roller unit holder 60 is turnably configured around a turning axis 60*a* provided to take a posture parallel to a rotation axis line of the secondary transfer roller 22. When the roller unit holder 60 rotates in a counter-clockwise direction in FIG. 2 around the turning axis 60*a*, the secondary transfer roller 22 held by the roller unit holder 60 is pressed against the intermediate transfer belt 20 to become in a contact state, so that the secondary transfer nipping portion is formed. When the roller unit holder 60 rotates in the clockwise direction in FIG. 2 around the turning axis 60*a*, the secondary transfer roller 22 held by the roller unit holder 60 is separated from the intermediate transfer belt 20 to become in a separated state.

In the apparatus body 100 according to the present example, a bias coil spring 65 always biases an end part of the roller unit holder 60 on an opposite side of the turning axis 60*a* toward the intermediate transfer belt 20. The bias coil spring 65 biases the secondary transfer roller 22 toward the intermediate transfer belt 20, by always applying force to the roller unit holder 60 to rotate the roller unit holder 60 in the counter-clockwise direction in FIG. 2 around the turning axis 60*a*. That is, the bias coil spring 65, the roller unit holder 60, the turning axis 60*a* of the roller unit holder 60, and the like configure the biasing unit that biases the secondary transfer roller 22 toward the intermediate transfer belt.

Rotation driving force of a roller driving motor is transmitted to the secondary transfer roller 22 via a drive transmitter such as a gear, so that the secondary transfer roller 22 is rotation-driven in the counter-clockwise direction in FIG. 2. The roller driving motor and the drive transmitter are also held by the roller unit holder 60, and are configured to turn together with the secondary transfer roller 22 and the roller unit holder 60. The roller unit holder 60 also holds a cleaning blade 64 that removes toners and paper particles adhered to the secondary transfer roller 22, a solid lubricator 61, and a lubricant presser 63 that presses the solid lubricator 61 against the secondary transfer roller 22.

A toner on the intermediate transfer belt 20 is adhered to the surface of the secondary transfer roller 22 that is in contact with the outer circumferential surface of the intermediate transfer belt 20 which holds a toner image. When the adhered toner is left as it is, there is a risk of the toner being transposed to the rear surface of the sheet P in the secondary transfer nipping portion, that is, the toner stains the rear surface. Therefore, the apparatus body 100 abuts the edge of the cleaning blade 64 against the surface of the secondary transfer roller 22, so that the toner is mechanically removed from the surface of the secondary transfer roller 22. In such a configuration, the abutting of the cleaning blade 64 applies a load of interfering the rotation of the secondary transfer roller 22. Accordingly, the secondary transfer roller 22 cannot be rotated following the rotation of the intermediate transfer belt 20. Therefore, the secondary transfer roller 22 is rotation-driven by the roller driving motor.

The lubricant presser 63 presses a solid lubricator 61 made of a zinc stearate lump and the like against the secondary transfer roller 22 with a coil spring 62, so that a lubricant powder is coated on the secondary transfer roller 22. By coating the lubricator in this way, increase in the rotation load due to the abutting of the cleaning blade 64 against the secondary transfer roller 22 is suppressed, and occurrence of inclusion of the blade edge is also suppressed. In place of pressing the solid lubricator 61 against the secondary transfer roller 22, there may be provided a rotary application brush for coating a lubricant onto the secondary transfer roller 22 while scrabbling the solid lubricator 61.

Figure 3:
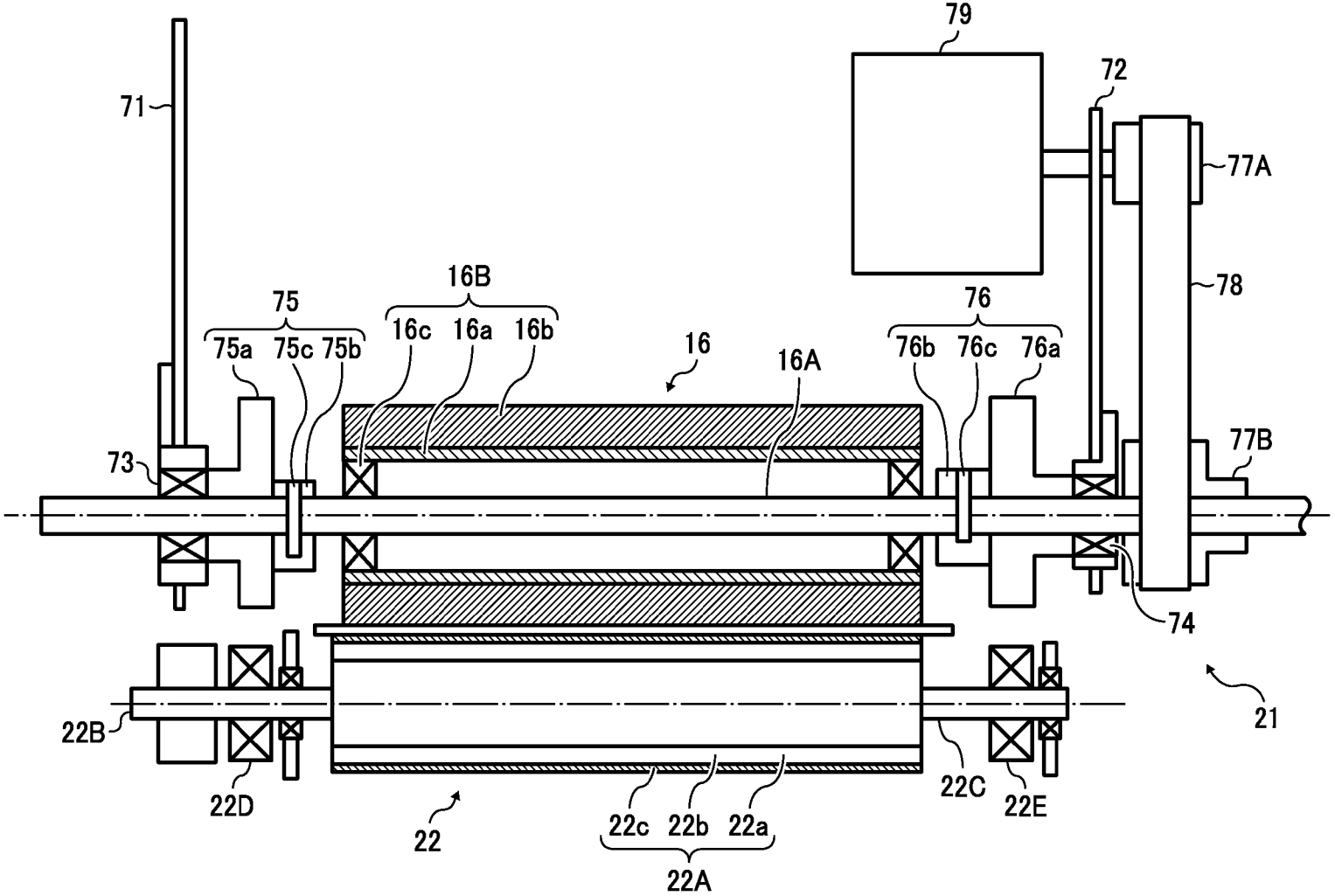
FIG. 3 is a cross-sectional view of a moving assembly of a secondary transfer roller held by the secondary transfer device according to Example 1.

Main configuration members of the secondary transfer device 21 according to the present example will be described in more detail with reference to FIG. 3. FIG. 3 is a cross-sectional view of a moving unit of the secondary transfer roller 22 in the secondary transfer device 21. In FIG. 3, the secondary transfer roller 22 includes a roller portion 22A, a first shaft member 22B and a second shaft member 22C that are stretched from both end surfaces of the roller 22A in an axial direction and extended to a rotation axial direction, and a first idle roller 22D and a second idle roller 22E that function as a follower described later. The roller portion 22A includes a cylindrical hollow metal core 22*a*, an elastic layer 22*b* made of an elastic member and fixed to a circumferential surface of the hollow metal core 22*a*, and a surface layer 22*c* fixed to a circumferential surface of the elastic layer 22*b*.

As metals that configure the hollow metal core 22*a*, there can be exemplified stainless steel and aluminum. However, materials of the hollow metal core 22*a* are not limited to these. The elastic layer 22*b* is desirably at 70° or below in JIS-A hardness. However, because the cleaning blade 64 is abutted against the roller portion 22A, various problems arise when the elastic layer 22*b* is too soft. Therefore, the elastic layer 22*b* is desirably at 40° or above in JIS-A hardness.

Epichlorohydrin rubber that exerts a certain level of conductivity forms an elastic layer 22*b* at about 50° in JIS-A hardness. As a rubber material exerting conductivity, in place of the conductive epichlorohydrin rubber, there may be used EPDM and Si rubber dispersed with rubber, and NBR, urethane rubber, and the like having an ion conductive function. Many rubber materials exert satisfactory chemical affinity with toners, and exert a relatively large friction coefficient. Therefore, the surface layer 22*c* covers the surface of the elastic layer 22*b* made of rubber. Consequently, adhesion of toners onto the surface of the roller portion 22A can be suppressed, and a sliding friction load to the blade can be reduced. As a material of the surface layer 22*c*, a fluororesin having a low friction coefficient and exerting a satisfactory toner releasability that contains therein a resistance adjusting material such as carbon and an ion conductive agent is satisfactory.

The secondary transfer roller 22 occasionally has a fine linear velocity difference from the intermediate transfer belt 20 when rotating in contact with the intermediate transfer belt 20. To avoid the intermediate transfer belt 20 from slipping due to the linear velocity difference, a friction coefficient of the surface layer 22*c* to the intermediate transfer belt 20 is adjusted to 0.3 or below. The intermediate transfer belt 20 is required to be driven at a constant velocity to be able to transfer a toner image of each color in superposition without a color shift. Therefore, it is important to lower the surface friction resistance of the surface layer 22*c* of the secondary transfer roller 22. The secondary transfer roller 22 configured in this way is biased toward the intermediate transfer belt 20 wound around the secondary-transfer opposing roller 16.

The secondary-transfer opposing roller 16 wound with the intermediate transfer belt 20 includes a roller portion 16B as a cylindrical body, and a penetrating shaft member 16A that penetrates a rotation center portion of the roller portion 16B in the rotation axial direction and that also makes the roller portion 16B turn idly on the surface of penetrating shaft member 16A. The penetrating shaft member 16A is made of a metal, and makes the roller portion 16B rotate idly freely on the circumferential surface of the penetrating shaft member 16A. The roller portion 16B includes a hollow metal core 16*a* in a drum shape, an elastic layer 16*b* made of an elastic member and fixed on the circumferential surface of the hollow metal core 16*a*, and ball bearings 16*c* pressurized into both ends of the hollow metal core 16*a* in the axial direction. The ball bearings 16*c* rotate on the penetrating shaft member 16A together with the hollow metal core 16*a* while supporting the hollow metal core 16*a*. The elastic layer 16*b* is pressurized into the outer circumferential surface of the hollow metal core 16*a*.

The penetrating shaft member 16A is rotatably supported by a first bearing 73 fixed to a first side plate 71 of a belt unit that tensions the intermediate transfer belt 20, and a second bearing 74 fixed to a second side plate 72. However, except a case where a cardboard as the sheet P described later is passed through, the penetrating shaft member 16A is stationary without being rotation-driven during most of the image forming operation. The roller portion 16B that attempts to rotate following the endless movement of the intermediate transfer belt 20 is made to rotate idly freely on the circumferential surface of the penetrating shaft member 16A.

The elastic layer 16*b* fixed onto the circumferential surface of the hollow metal core 16*a* is formed of a conductive rubber material of which a resistance value is adjusted by adding an ion conductive agent to exert a resistance equal to or more than 7.5 Log Ω. The electric resistance of the elastic layer 16*b* is adjusted in a predetermined range in order to prevent the occurrence of the following inconvenience when using a recording sheet of which a size in a roller axis line direction is relatively small like the A5 size. The inconvenience is that a transfer current is concentrated on a portion where the intermediate transfer belt 20 and the secondary transfer roller 22 are in direct contact with each other without via the recording sheet in the secondary transfer nip. By setting an electric resistance of the elastic layer 16*b* to a value larger than the resistance of the recording sheet, concentration of the transfer current can be suppressed.

As a conductive rubber material forming the elastic layer 16*b*, foamed rubber is used to exert elasticity of about 40° in Asker-C hardness. By forming the elastic layer 16*b* by such foamed rubber, it is possible to flexibly deform the elastic layer 16*b* in a thickness direction in the secondary transfer nip and to form a secondary transfer nip having a certain level of width in the sheet conveyance direction. In the image forming apparatus 500, because the cleaning blade 64 is abutted against the secondary transfer roller 22 as described above, it is difficult to use a very elastic material as a material of the roller portion 22A of the secondary transfer roller 22. Therefore, in place of the secondary transfer roller 22, the roller portion 16B of the secondary-transfer opposing roller 16 is elastically deformed.

In the penetrating shaft member 16A of the secondary-transfer opposing roller 16, a first cam 75 and a second cam 76 that are abutting members and abutted against the secondary transfer roller 22 are fixed to rotate integrally with the penetrating shaft member 16A, in both end regions in the longitudinal direction not positioned in the roller portion 16B. Specifically, the first cam 75 is fixed to one end part region in the longitudinal direction of the penetrating shaft member 16A. In the first cam 75, mainly a cam portion 75*a* and a roller portion 75*b* in a perfect circular shape are integrally formed by being arrayed in the axial direction. A screw 75*c* penetrating the roller portion 75*b* is meshed with the penetrating shaft member 16A to fix the first cam 75 to the penetrating shaft member 16A. The second cam 76 in a configuration similar to that of the first cam 75 is fixed in the other end region in the longitudinal direction of the penetrating shaft member 16A.

A drive receiving pulley 77B is fixed in an outer region of the second cam 76 in the axial direction of the penetrating shaft member 16A. On the other hand, a cam driving motor 79 formed of a stepping motor is fixed to a second side plate 72 of the belt unit. A drive output pulley 77A is fixed to a motor shaft of the cam driving motor 79, and a timing belt 78 is tensioned on a drive output pulley 77A and the drive receiving pulley 77B. In the above configuration, by driving the cam driving motor 79, the penetrating shaft member 16A is rotated, so that the first cam 75 and the second cam 76 fixed to the penetrating shaft member 16A can be rotated. At this time, even when the penetrating shaft member 16A is rotated, the roller portion 16B can be rotated idly freely on the penetrating shaft member 16A. Therefore, rotation of the roller portion 16B following the intermediate transfer belt 20 is not interrupted.

For switching an opposition state of the intermediate transfer belt 20 and the secondary transfer roller 22 from the contact state in FIG. 3 to a separated state shown, the cam driving motor 79 is driven to rotate the first cam 75 and the second cam 76. By the rotation, the outer circumferential surfaces of the first cam 75 and the second cam 76 are abutted against the first idle roller 22D and the second idle roller 22E that function as a follower and are provided in the secondary transfer roller 22, so that the first idle roller 22D and the second idle roller 22E are pressed down against the bias force of the bias coil spring 65 of the roller unit holder 60. As a result, the secondary transfer roller 22 moves in a direction away from the secondary-transfer opposing roller 16, and finally, the intermediate transfer belt 20 and the secondary transfer roller 22 become in a separated state.

On the other hand, for switching a contact-and-separated state of the intermediate transfer belt 20 and the secondary transfer roller 22 from the separated state to the contact state shown in FIG. 3, the cam driving motor 79 is driven to rotate the first cam 75 and the second cam 76. By the rotation, in a state of the idle rollers 22D and 22E being in contact with respective cam surfaces, the idle rollers 22D and 22E are pressed up by the bias force of the bias coil spring 65 of the roller unit holder 60. As a result, the secondary transfer roller 22 moves in a direction of approaching the secondary-transfer opposing roller 16, and finally, the intermediate transfer belt 20 and the secondary transfer roller 22 are abutted against each other by the bias force of the bias coil spring 65, so that the secondary transfer nipping portion is formed. At this time, the idle rollers 22D and 22E of the secondary transfer roller 22 become in a state of being separated from the outer circumferential surfaces of the cams 75 and 76.

In the above configuration, the moving unit that moves the secondary transfer roller 22 to be contacted to and separated from the intermediate transfer belt 20 is configured by the cams 75 and 76, the cam driving motor 79, the idle rollers 22D and 22E, the pulleys 77A and 77B, the timing belt 78, and the biasing unit. As described above, the biasing unit is mainly configured by the bias coil spring 65, the roller unit holder 60, and the turning axis 60*a* of the roller unit holder 60.

The secondary transfer device 21 grounds the hollow metal core 22*a* of the secondary transfer roller 22 as indicated by GND in FIG. 2. On the other hand, the secondary transfer device 21 applies a secondary transfer bias having the same polarity as that of the toner to the hollow metal core 16*a* of the secondary-transfer opposing roller 16. Consequently, in the secondary transfer nipping portion, a secondary transfer roller electric field for electrostatically moving the toner from a secondary-transfer opposing roller 16 side to a secondary transfer roller 22 side is formed between both rollers.

The first bearing 73 rotatably receiving the penetrating shaft member 16A, which is made of metal, of the secondary-transfer opposing roller 16 is formed of a conductive sliding bearing. A high-voltage power source that outputs a secondary transfer bias is connected to the conductive first bearing 73. The secondary transfer bias output from the high-voltage power source is guided to the secondary-transfer opposing roller 16 via the conductive first bearing 73. In the secondary-transfer opposing roller 16, the secondary transfer bias is sequentially transmitted to the metal-made penetrating shaft member 16A, the ball bearings 16*c* made of metal, the hollow metal core 16*a* made of metal, and the elastic layer 16*b* having conductivity.

A disk to be detected of an encoder that detects rotation angle positions of the first cam 75 and the second cam 76 and an angular velocity of the rotation is fixed to one end of the penetrating shaft member 16A, so that a disk center and the rotation axis center of the penetrating shaft member 16A become coaxial. The disk to be detected rotates integrally with the first cam 75 and the second cam 76 fixed to the penetrating shaft member 16A, and movement of the disk is detected by a detector of the encoder. A detection result is transmitted to a controller of the image forming apparatus 500. The controller accepts the rotation angle positions of the first cam 75 and the second cam 76 and the angular velocity of the rotation, and controls the drive of the cam driving motor 79.

As described above, the first cam 75 and the second cam 76 are respectively abutted at a predetermined rotation angle against the first idle roller 22D and the second idle roller 22E of the secondary transfer roller 22. Then, the secondary transfer roller 22 is pressed down in a direction away from the secondary-transfer opposing roller 16 against the bias force of the bias coil spring 65. A press-down amount at this time is determined by rotation angle positions of the cams 75 and 76. When the press-down amount of the secondary transfer roller 22 becomes larger, an inter-axis distance between the secondary-transfer opposing roller 16 and the secondary transfer roller 22 becomes larger.

In the secondary transfer roller 22, the first idle roller 22D is provided to be able to rotate idly in the first shaft member 22B that rotates integrally with the roller portion 22A. In the second shaft member 22C of the secondary transfer roller 22, the second idle roller 22E having a configuration similar to that of the first idle roller 22D is provided to be able to rotate idly. Rotation of the idle rollers 22D and 22E against which the cams 75 and 76 are abutted in the secondary-transfer opposing roller 16 is interfered by the abutting. However, the rotation of the secondary transfer roller 22 is not interrupted by the interference. Because the idle rollers 22D and 22E are ball bearings, even when the idle rollers 22D and 22E stop rotating, the shaft members 22B and 22C of the secondary transfer roller 22 can rotate freely independently of the idle rollers 22D and 22E. By stopping the rotation of the idle rollers 22D and 22E following the abutting by the cams 75 and 76, occurrence of sliding friction between the cams and the idle rollers can be avoided. Further, occurrence of increase in the torque due to the sliding friction of the driving motor that rotation-conveys the intermediate transfer belt 20 and the driving motor of the secondary transfer roller 22 can be also avoided.

Figure 4:
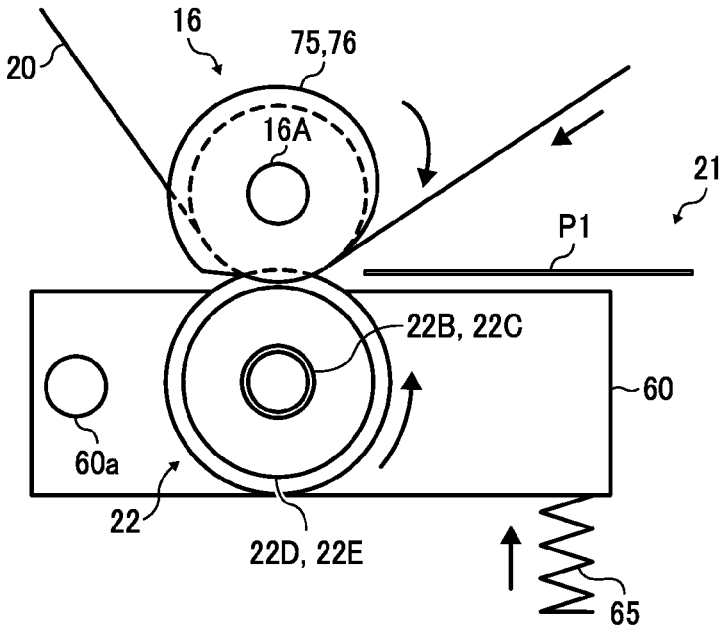
FIG. 4 is a schematic view showing a state of a secondary transfer nipping portion immediately before making a piece of regular paper enter according to Example 1.
Figure 5:
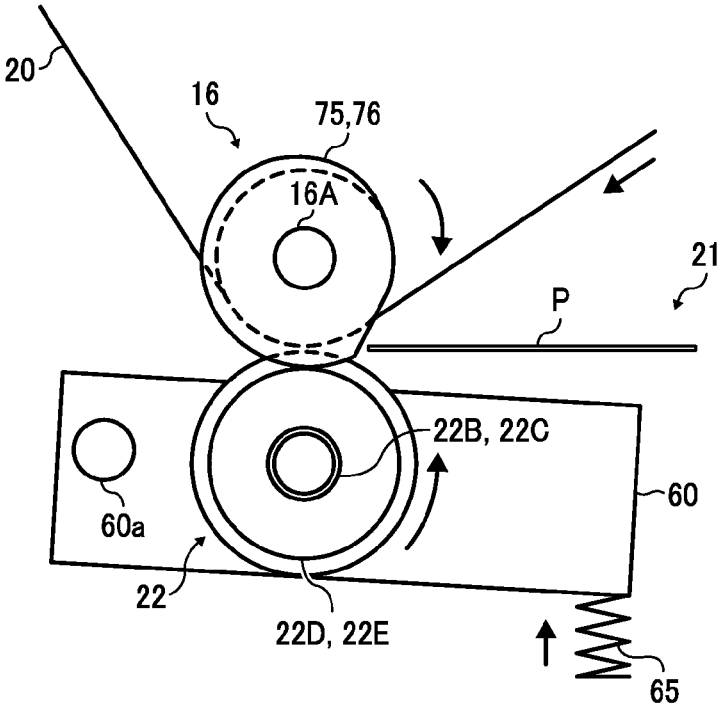
FIG. 5 is a schematic view of a state of the secondary transfer nipping portion immediately before making a cardboard enter according to Example 1.

Next, movement of the secondary transfer roller 22 by the moving unit in the secondary transfer device 21 according to the present example will be described in more detail. FIG. 4 is a schematic view showing a state of a secondary transfer nipping portion immediately before a piece of regular paper P1 as the sheet P enters. FIG. 5 is a schematic view of a state of the secondary transfer nipping portion immediately before a cardboard P2 as the sheet P enters. In the secondary transfer device 21 according to the present example, the cams 75 and 76 are rotated to switch between a state of the secondary transfer roller 22 being abutted against the intermediate transfer belt 20 as shown in FIG. 4 and a state of the secondary transfer roller 22 being separated from the intermediate transfer belt 20 as shown in FIG. 5.

As shown in FIG. 4, when passing the regular paper P1 through, the regular paper P1 is made to enter the secondary transfer nipping portion in a state of the cams 75 and 76 being separated from the idle rollers 22D and 22E, except when a secondary transfer is not performed in an image-forming waiting time, in an adjustment operation inside the image forming apparatus 500, and the like. That is, the secondary transfer roller 22 is pressed against the intermediate transfer belt 20 by bias force of the moving unit. In a state of a nipping pressure being generated in the secondary transfer nipping portion, the regular paper P1 is made to enter the secondary transfer nipping portion. The regular paper P1 is thinner than the cardboard P2 in the sheet thickness. Further, a spring constant of the bias coil spring 65 included in the moving unit of the secondary transfer device 21 is optimized not to rapidly increase the nipping pressure even when the regular paper P1 enters the secondary transfer nipping portion.

However, when the cardboard P2 thicker than the regular paper P1 in the sheet thickness is made to enter the secondary transfer nipping portion in the state shown in FIG. 4, there occur the impact when the cardboard P2 collides against the surface of the secondary transfer roller 22 and/or the intermediate transfer belt 20, and a rapid variation in the nipping pressure when the cardboard P2 is sandwiched. Oscillation occurs in the secondary transfer roller 22 at the secondary transfer nipping portion due to the impact and the rapid nipping pressure variation. At the same time, oscillation and a rapid velocity variation occur in the intermediate transfer belt, which produces an adverse effect on the secondary transfer and the primary transfer. As a result, image quality reduction such as what is called shock jitter occurs. Further, when continuously passing the cardboard P2 through, image quality reduction such as shock jitter occurs each time when the cardboard P2 passes through the secondary transfer nipping portion.

In the present example, a moving velocity of the secondary transfer roller 22 in the operation of making the secondary transfer nipping portion generate a predetermined nipping pressure by abutting the secondary transfer roller 22 against the intermediate transfer belt 20, and a timing of making the cardboard P2 enter the secondary transfer nipping portion are configured as follows. The predetermined nipping pressure is not a final nipping pressure generated between the intermediate transfer belt 20 and the secondary transfer roller 22 by moving the secondary transfer roller 22 to be in contact with the intermediate transfer belt 20 via the sheet P such as the cardboard P2 by the biasing unit of the moving unit. The predetermined nipping pressure is a nipping pressure at which apparent aggravation of secondary transfer is not observed by moving the secondary transfer roller 22 to be in contact with the intermediate transfer belt 20 via the sheet P such as the cardboard P2. Before a final nipping pressure is generated in the secondary transfer nipping portion, the cams 75 and 76 and the idle rollers 22D and 22E as a follower are separated. Consequently, all the bias force by the biasing unit is added to each member constituting the secondary transfer nipping portion and the sheet P, so that the final nipping pressure is generated.

The abutting operation for generating a predetermined nipping pressure in the secondary transfer nipping portion by abutting the secondary transfer roller 22 against the intermediate transfer belt 20 via the sheet P is divided into two operations. A first operation is the nipping-pressure generation start operation in the secondary transfer nipping portion by abutting the secondary transfer roller 22 against the intermediate transfer belt 20 via the sheet P. A second operation is a pressing operation of moving the secondary transfer roller toward the intermediate transfer belt to the necessary nipping-pressure position (position where a predetermined nipping pressure is generated in the secondary transfer nipping portion), after the nipping-pressure generation start operation. When the cardboard P2 is thinner than a maximum separation distance between the intermediate transfer belt and the secondary transfer roller, the nipping-pressure generation start operation in the secondary transfer nipping portion from a state of the intermediate transfer belt and the secondary transfer roller being separated can be divided into the following two operations. These operations are an approaching operation of making the secondary transfer roller approach the intermediate transfer belt, and a contact operation of bringing the secondary transfer roller in contact with the intermediate transfer belt to start generating the nipping pressure via the sheet P.

However, when the cardboard P2 is thicker than the maximum separation distance between the intermediate transfer belt and the secondary transfer roller, image quality reduction such as shock jitter occurs. Therefore, in the secondary transfer device 21 according to the present example, the maximum separation distance is set larger than a maximum sheet thickness of the cardboard P2 that is passed through. A configuration is provided such that the moving velocity in the contact operation of the secondary transfer roller 22 toward the intermediate transfer belt 20 becomes slower than the moving velocity at least in the pressing operation and that the cardboard P2 is made to enter the transfer nipping portion in the contact operation.

As described above, because the sheet P such as the cardboard P2 is made to enter the secondary transfer nipping portion in the contact operation of start generating the nipping pressure, a rapid increase in the nipping pressure generated when the cardboard enters can be reduced more than that in a transfer device that makes the sheet enter the secondary transfer nipping portion in a nipping pressure generated state. That is, because the secondary transfer roller 22 as a transfer roller is moved to be in contact with the intermediate transfer belt 20 as an image carrier via the sheet P as a recording medium, a rapid increase in the nipping pressure generated when a cardboard enters can be reduced. Therefore, the occurrence of shock jitter when making the sheet P enter the secondary transfer nipping portion can be suppressed more than that in a secondary transfer device that makes the sheet enter the secondary transfer nipping portion in a nipping pressure generated state.

Even when the sheet conveyance velocity becomes fast, by suppressing the increase in the moving velocity in the contact operation and by increasing the moving velocity in the pressing operation, the secondary transfer roller 22 can be moved to the necessary nipping-pressure position before the image-forming region of the recording medium enters the secondary transfer nipping portion. Therefore, even when the sheet conveyance velocity becomes fast, image quality reduction attributable to transfer pressure shortage can be suppressed, and the moving velocity of the secondary transfer roller 22 toward the intermediate transfer belt 20 in the contact operation can be slower than that of a secondary transfer device in which the moving velocity is the same at both of the contact operation and the pressing operation. Therefore, the impact when the cardboard P2 enters the secondary transfer nipping portion can be reduced more than that in a conventional secondary transfer device in which the moving velocity of the secondary transfer roller is the same at both of the pressing operation and the contact operation. Consequently, the suppression effect of suppressing image quality reduction such as shock jitter can be further enhanced. That is, this embodiment can provide a secondary transfer device that contacts and separates the secondary transfer roller 22 to and from the intermediate transfer belt 20. The secondary transfer device 21 reduces the impact when making the sheet P such as the cardboard P2 enter the secondary transfer nipping portion, and can suppress image quality reduction such as shock jitter compared to a conventional practice.

By using the first cam 75 and the second cam 76 as the moving unit for moving the secondary transfer roller 22 so as to be contacted to and separated from the intermediate transfer belt 20 and abutting the first cam 75 and the second cam 76 against the follower like the first idle roller 22D and the second idle roller 22E, there are also the following effects. By using the cams as the moving unit of the secondary transfer roller, the secondary transfer roller 22 can be moved in a simple configuration, and the cost of the secondary transfer device 21 can be reduced. Further, because the first cam 75 and the second cam 76 are held by the penetrating shaft member 16A that rotatably supports the secondary-transfer opposing roller 16, there are also the following effects. The transfer device can be made more compact than a configuration in which a member holding the first cam 75 and the second cam 76 that move the secondary transfer roller 22 is provided separately from the penetrating shaft member 16A as a rotary shaft of the secondary-transfer opposing roller 16. At the same time, the cost of the transfer device can be reduced by decreasing the number of parts.

Next, a moving velocity of the secondary transfer roller in each operation and a timing of making the cardboard P2 enter the secondary transfer nipping portion will be described in detail with reference to drawings based on a plurality of examples.

Figure 6:
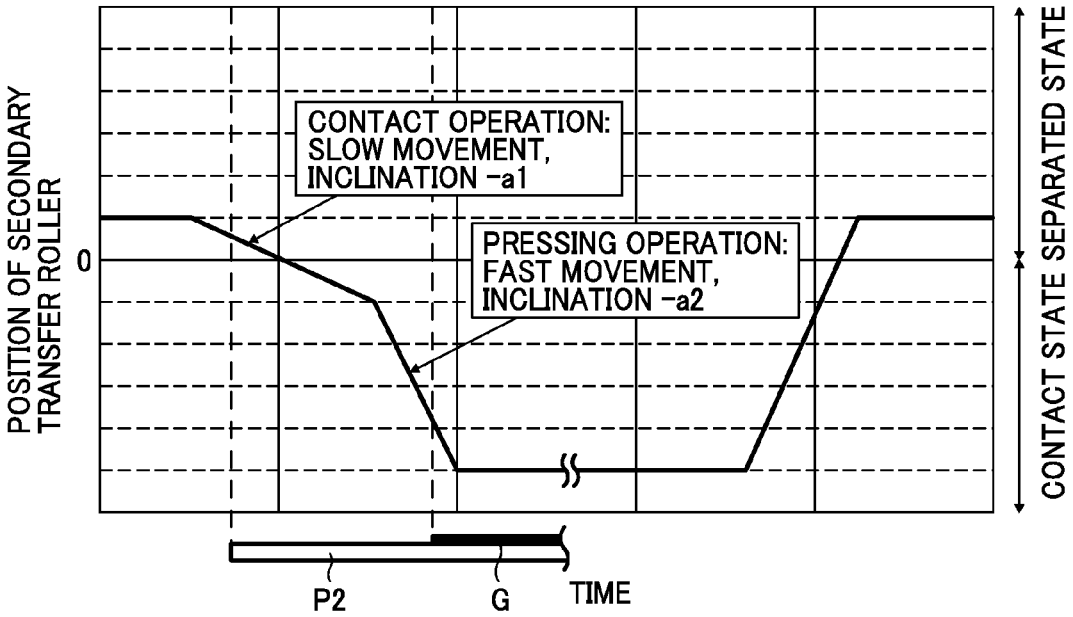
FIG. 6 is a timing chart of movement of a secondary-transfer roller position and a passing of a cardboard through when an abutting operation is divided into a contact operation and a pressing operation.
Figure 7:
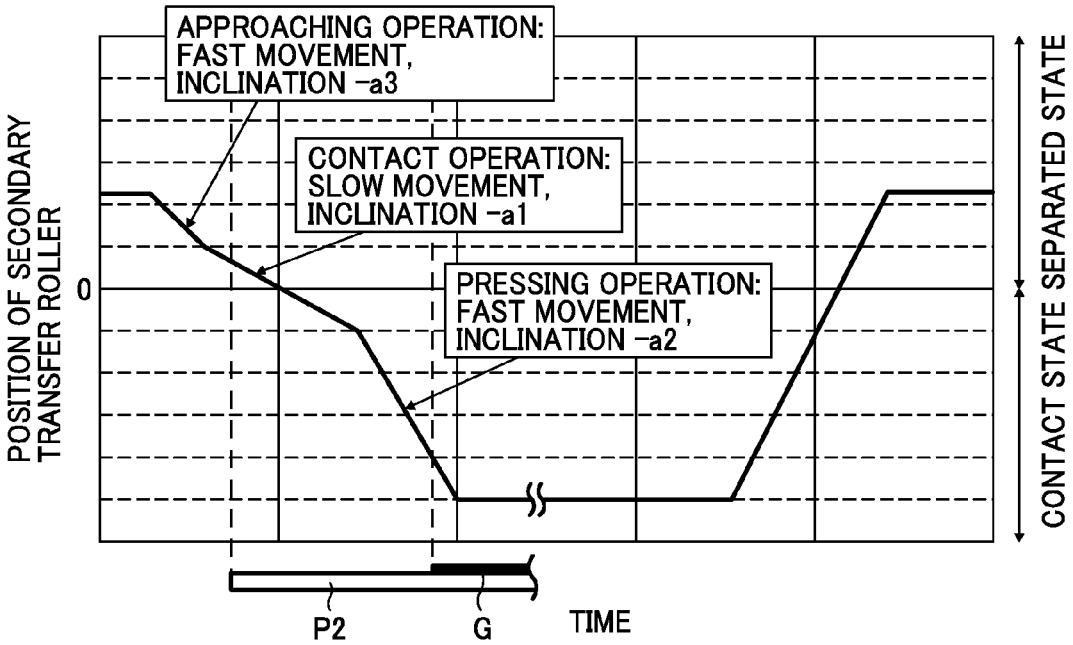
FIG. 7 is a timing chart of movement of a secondary-transfer roller position and passing of a cardboard through when an abutting operation is divided into an approaching operation, a contact operation, and a pressing operation.

FIG. 6 shows a timing chart of movement of a secondary-transfer roller position and passing of a cardboard through by when an abutting operation is divided into a contact operation and a pressing operation. FIG. 7 is a timing chart of movement of a secondary-transfer roller position and passing of a cardboard through when an abutting operation is divided into an approaching operation, a contact operation, and a pressing operation. In FIG. 6 and FIG. 7, a position of the secondary transfer roller 22 in contact with the intermediate transfer belt 20 is set as a reference which is expressed as 0 in a vertical axis. An upper range shows separation, and a lower range shows abutting. At a separation time, a separation distance of the secondary transfer roller 22 from the intermediate transfer belt 20 becomes a value of the vertical axis. At an abutting time, a pushing depth of the secondary transfer roller 22 into the intermediate transfer belt 20 becomes a value of the vertical axis. That is, at an upper side, the separation distance of the secondary transfer roller 22 from the intermediate transfer belt 20 becomes large. At a lower side, the pushing depth of the secondary transfer roller 22 into the intermediate transfer belt 20 increases.

First, an example that the abutting operation is divided into a contact operation and a pressing operation will be described with reference to FIG. 6. As shown in FIG. 6, in this example, a moving velocity in the contact operation of moving the secondary transfer roller 22 toward the intermediate transfer belt 20 (moment when the secondary transfer roller 22 and the intermediate transfer belt 20 are brought into contact with each other via the cardboard P2) is set slower than a moving velocity in the pressing operation after the contact operation. That is, an inclination of a line indicating a position of the secondary transfer roller 22 shown in FIG. 6 is configured to become a1<a2. By providing such a configuration, the impact when the cardboard P2 enters the secondary transfer nipping portion can be reduced. As a result, a suppression effect of suppressing the image quality reduction such as shock jitter can be further enhanced.

Even when the conveyance velocity of the cardboard P2 becomes fast, by suppressing the increase in the moving velocity in the contact operation and by increasing the moving velocity in the pressing operation, the secondary transfer roller 22 can be moved to the necessary nipping-pressure position before the image-forming region of the cardboard P2 enters the secondary transfer nipping portion. Therefore, even when the sheet conveyance velocity of the cardboard P2 becomes faster, image quality reduction attributable to transfer pressure shortage can be suppressed. It is also possible to prevent the cardboard P2 from passing through before stabilizing the nipping pressure, that is, a secondary transfer pressure, at the secondary transfer nipping portion, due to too slow movement of the secondary transfer roller 22.

Specifically, before the cardboard P2 is made to enter the secondary transfer nipping portion, the cams 75 and 76 are rotated in the counter-clockwise direction in FIG. 4 from the state of the secondary transfer roller 22 being abutted against the intermediate transfer belt 20 shown in FIG. 4. Then, the state is switched to a state of the secondary transfer roller 22 being separated from the intermediate transfer belt 20 shown in FIG. 5. At this time, against the bias force of the biasing unit, the cams 75 and 76 press down the idle rollers 22D and 22E provided in the secondary transfer roller 22 opposing on the outer circumferential surfaces of the cams. By the press down in this way, a distance between the penetrating shaft member 16A as a rotary shaft of the secondary-transfer opposing roller 16 and a shaft center of the shaft members 22B and 22C as a rotary shaft of the secondary transfer roller 22 is changed, so that the secondary transfer roller 22 is pressed down and is separated from the intermediate transfer belt 20. The separated state is a state that a position of the secondary transfer roller 22 before the contact operation is constant as shown in FIG. 6.

Thereafter, before the cardboard P2 is made to enter the secondary transfer nipping portion, the contact operation of nipping-pressure generation start in the secondary transfer nipping portion is started, by bringing the secondary transfer roller 22 into contact with the intermediate transfer belt 20, at a moving velocity of the secondary transfer roller 22 slower than that at a subsequent pressing operation. After the contact operation is started in this way, the cardboard P2 is made to enter the secondary transfer nipping portion in the contact operation, and the intermediate transfer belt 20 and the secondary transfer roller 22 are brought into contact with each other via the cardboard P2. After the contact operation, before an image-forming region G of the cardboard P2 enters the secondary transfer nipping portion, the operation shifts to the pressing operation, and the secondary transfer roller 22 is moved at a moving velocity faster than in the contact operation. The secondary transfer roller 22 is moved to the necessary nipping position (position where a predetermined nipping pressure is generated). After the secondary transfer roller 22 moves to the necessary nipping position, the moving velocity of the secondary transfer roller 22 is maintained until the cams 75 and 76 are separated from the idle rollers 22D and 22E. The image-forming region G of the cardboard P2 enters the secondary transfer nipping portion. After the image-forming region G of the cardboard P2 passes through the secondary transfer nipping portion, the operation shifts to the separation operation of separating the secondary transfer roller 22 from the intermediate transfer belt 20. A series of the contact operation, the pressing operation, and the separation operation are repeated each time when the cardboard P2 is passed through.

Next, an example that the abutting operation is divided into an approaching operation, a contact operation, and a pressing operation will be described with reference to FIG. 7. The example that the abutting operation is divided into a contact operation and a pressing operation is different from the present example in only that the nipping-pressure generation start operation in the secondary transfer nipping portion from the state of the intermediate transfer belt and the secondary transfer roller being separated is divided into the approaching operation and the contact operation. Therefore, a description concerning a configuration similar to that described above will be appropriately omitted.

As shown in FIG. 7, in the present example, as described above, the nipping-pressure generation start operation in the secondary transfer nipping portion by sandwiching the cardboard P2 from the state of the intermediate transfer belt 20 and the secondary transfer roller 22 being separated from each other is divided into the approaching operation and the contact operation. Then, in a similar manner to that of the above example, the moving velocity in the contact operation of moving the secondary transfer roller 22 toward the intermediate transfer belt 20 is set slower than the moving velocity in the pressing operation. That is, an inclination of a line indicating a position of the secondary transfer roller 22 shown in FIG. 7 is configured to become a1<a2. In addition, in the present example, the moving velocity in the contact operation of moving the secondary transfer roller 22 toward the intermediate transfer belt 20 is set slower than the moving velocity in the approaching operation. That is, an inclination of a line indicating a position of the secondary transfer roller 22 shown in FIG. 7 is configured to become a1<a2, a3.

By providing such a configuration, the impact when the cardboard P2 enters the secondary transfer nipping portion can be reduced. As a result, a suppression effect of suppressing the image quality reduction such as shock jitter can be further enhanced. Further, in the abutting operation, the moving velocity only in the contact operation is set slower than in approaching operation and in the pressing operation. By setting a slow moving velocity only in the contact operation in this way, it is possible to provide a secondary transfer device that can achieve high image quality by suppressing shock jitter and the like, can shorten the time required for the abutting operation by making fast the other approaching operation and pressing operation, and can achieve a high velocity.

Figure 8:
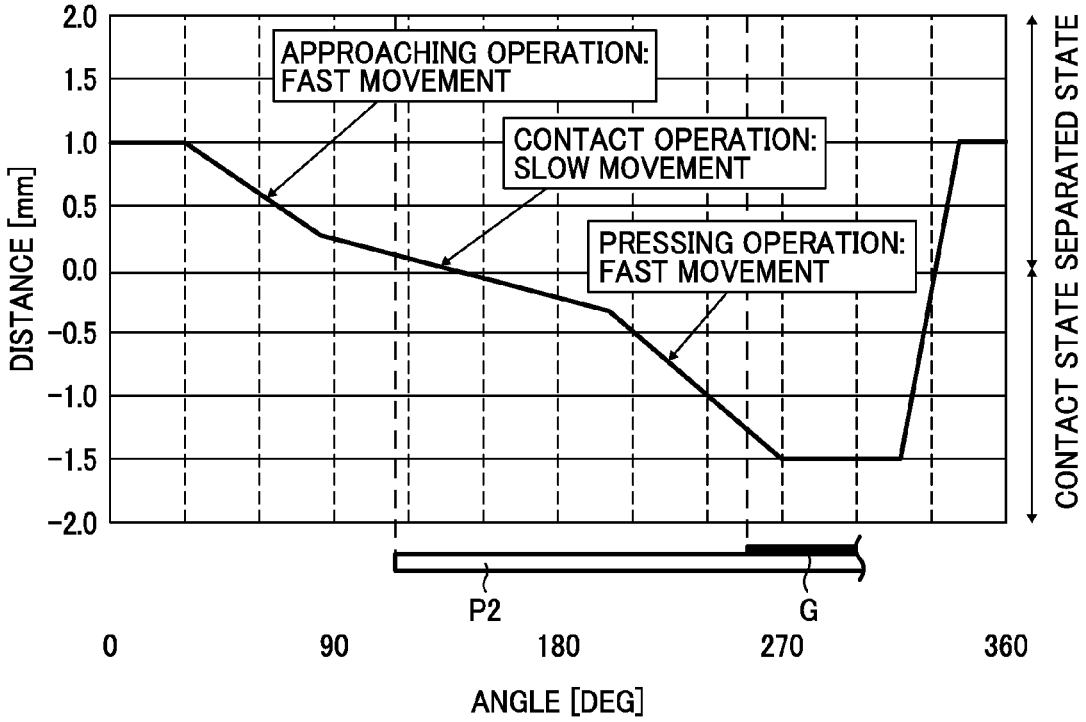
FIG. 8 is a cam line diagram when an abutting operation is divided into an approaching operation, a contact operation, and a pressing operation.
Figure 9:
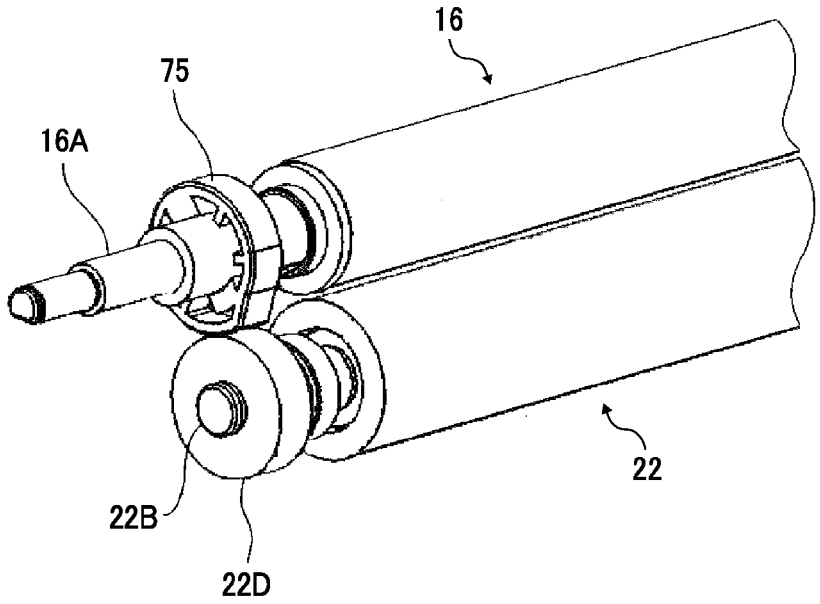
FIG. 9 is a perspective view of a state that the secondary-transfer opposing roller and the secondary transfer roller are separated when a rotation position of the cam is near 0 degree.
Figure 10A:
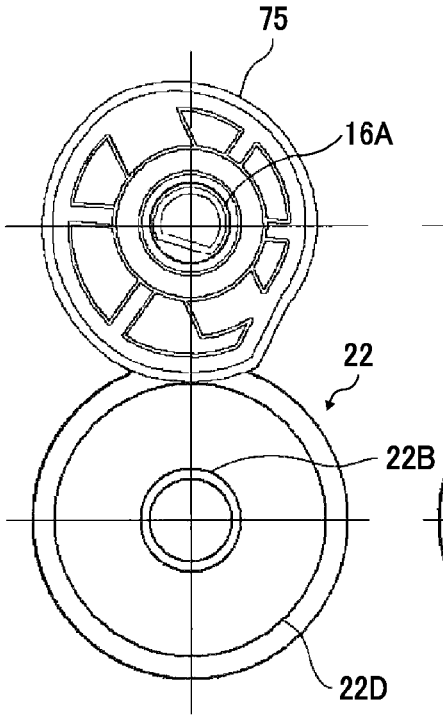
FIGS. 10A and 10B are views of a state of the cam, the roller, the secondary-transfer opposing roller, and the secondary transfer roller when a rotation position of the cam is near 0 degree.
Figure 10B:
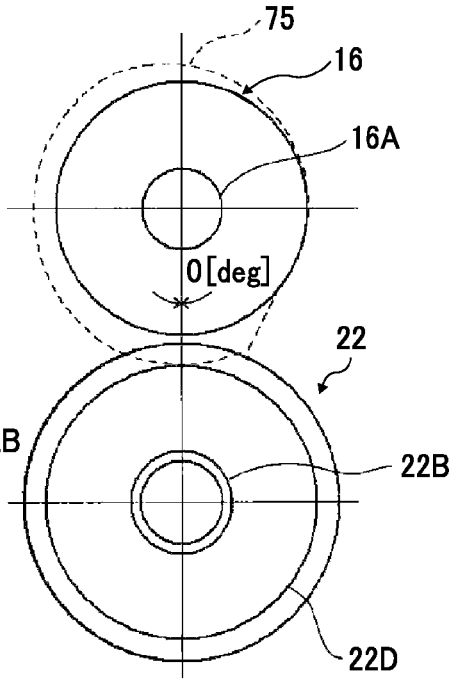
Figure 11:
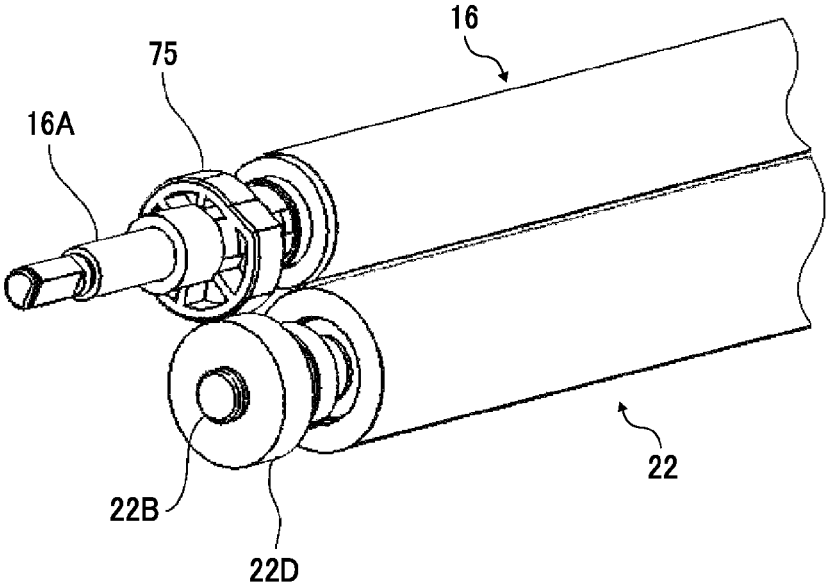
FIG. 11 is a perspective view of a state that the secondary-transfer opposing roller and the secondary transfer roller are separated when a rotation position of the cam is near 70 degrees.
Figure 12A:
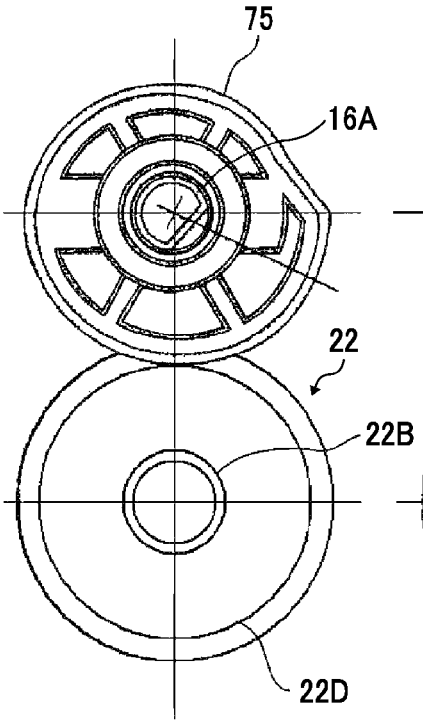
FIGS. 12A and 12B are views of a state of the cam, the roller, the secondary-transfer opposing roller, and the secondary transfer roller when a rotation position of the cam is near 70 degrees.
Figure 12B:
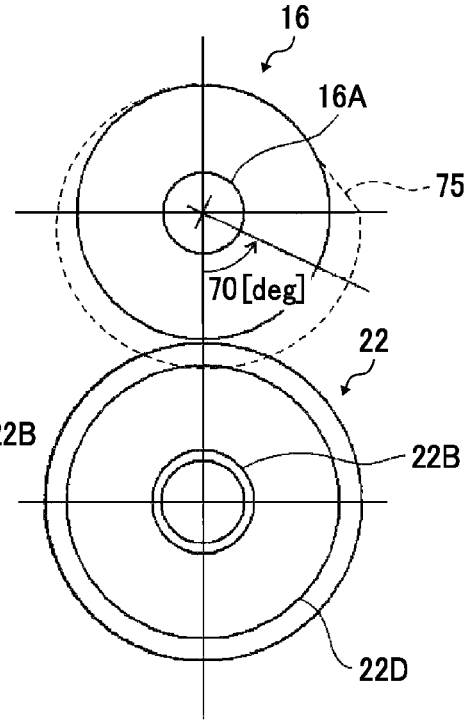

Next, when the abutting operation is divided into an approaching operation, a contact operation, and a pressing operation, shapes of the cams 75 and 76 and angular velocities of rotation that change the moving velocity of the secondary transfer roller 22 toward the intermediate transfer belt 20 at each operation will be described by taking the first cam 75 as an example. When forming the secondary transfer nip sandwiching the cardboard P2, the intermediate transfer belt 20 and the secondary transfer roller 22 are brought into contact with each other via the cardboard P2. The following drawings show states of the secondary-transfer opposing roller 16, the secondary transfer roller 22, the first idle roller 22D, and the first cam 75. FIG. 8 is a cam line diagram when the abutting operation is divided into the approaching operation, the contact operation, and the pressing operation. FIG. 9 is a perspective view of a state of the secondary-transfer opposing roller and the secondary transfer roller being separated when a rotation position of the first cam 75 is near 0 degree. FIGS. 10A and 10B are views of states of the first cam 75, the roller, the secondary-transfer opposing roller, and the secondary transfer roller when a rotation position of the first cam 75 is near 0 degree. FIG. 11 is a perspective view of a state of the secondary-transfer opposing roller and the secondary transfer roller being separated when a rotation position of the cam is near 70 degrees. FIGS. 12A and 12B are views of states of the cam, the roller, the secondary-transfer opposing roller, and the secondary transfer roller when a rotation position of the cam is near 70 degrees.

Figure 13:
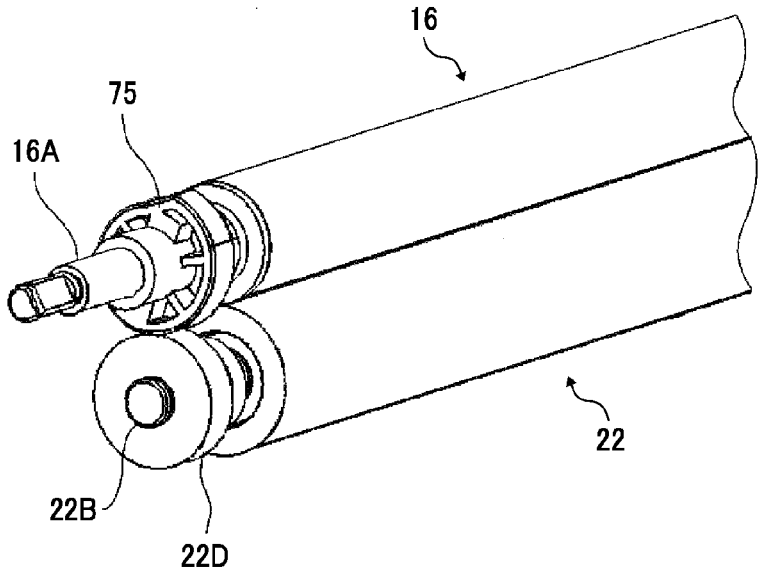
FIG. 13 is a perspective view of a state that the secondary-transfer opposing roller and the secondary transfer roller are brought into contact with each other when a rotation position of the cam is near 140 degrees.
Figure 14A:
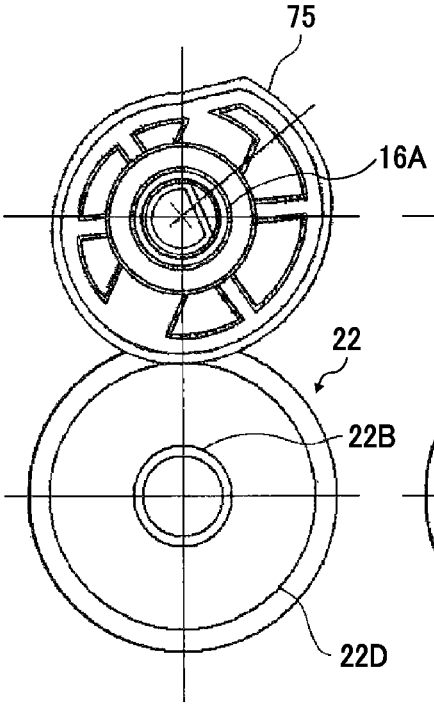
FIGS. 14A and 14B are views of states of the cam, the roller, the secondary-transfer opposing roller, and the secondary transfer roller when a rotation position of the cam is near 140 degrees.
Figure 14B:
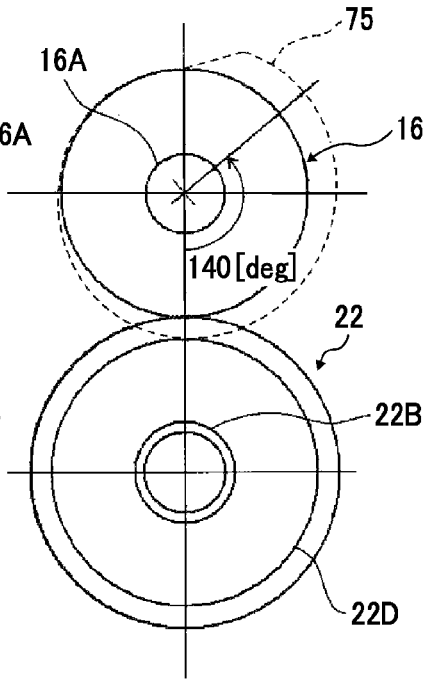
Figure 15:
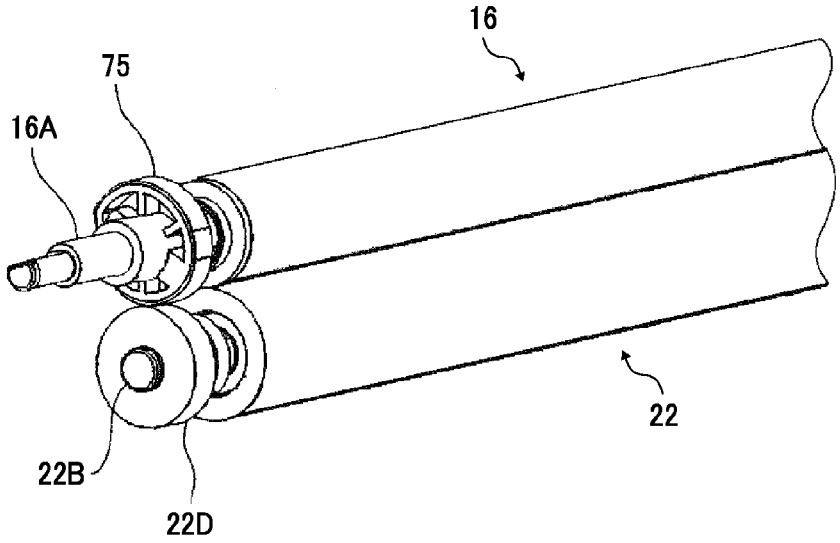
FIG. 15 is a perspective view of a state that the secondary-transfer opposing roller and the secondary transfer roller form a nipping portion when a rotation position of the cam is near 210 degrees.
Figure 16A:
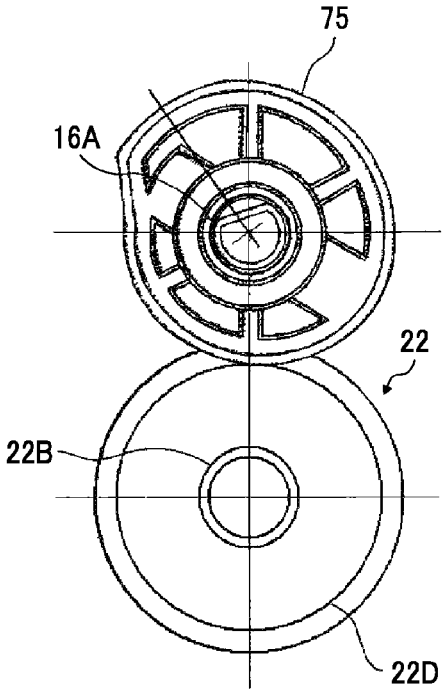
FIGS. 16A and 16B are views of states of the cam, the roller, the secondary-transfer opposing roller, and the secondary transfer roller when a rotation position of the cam is near 210 degrees.
Figure 16B:
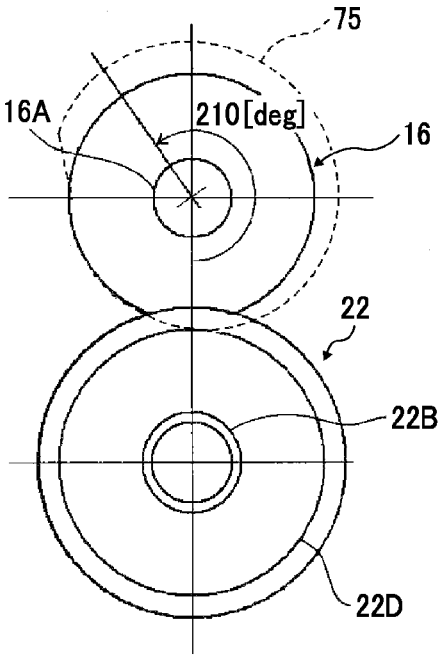
Figure 17:
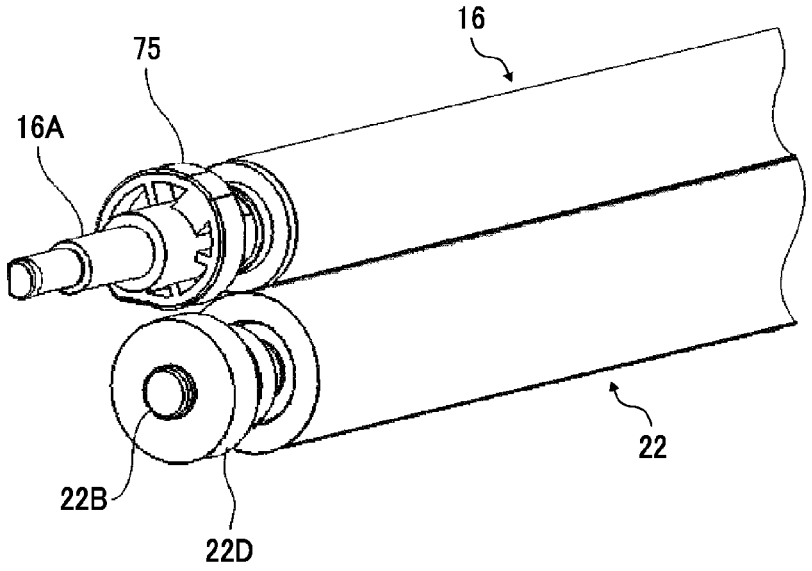
FIG. 17 is a perspective view of a state that the secondary-transfer opposing roller and the secondary transfer roller form a nipping portion when a rotation position of the cam is near 300 degrees.
Figure 18A:
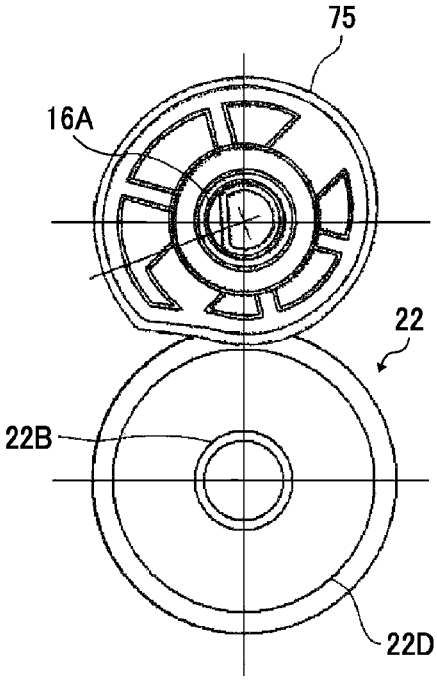
FIGS. 18A and 18B are views of states of the cam, the roller, the secondary-transfer opposing roller, and the secondary transfer roller when a rotation position of the cam is near 300 degrees.
Figure 18B:
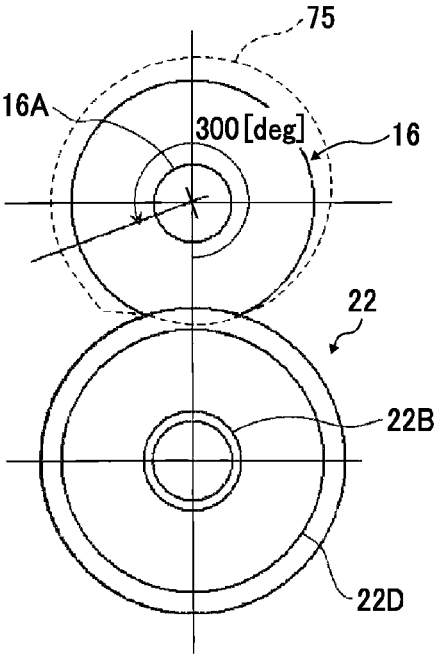

FIG. 13 is a perspective view of a state of the secondary-transfer opposing roller and the secondary transfer roller being brought into contact with each other when a rotation position of the cam is near 140 degrees. FIGS. 14A and 14B are views of states of the cam, the roller, the secondary-transfer opposing roller, and the secondary transfer roller when a rotation position of the cam is near 140 degrees. FIG. 15 is a perspective view of a state that the secondary-transfer opposing roller and the secondary transfer roller form a nipping portion when a rotation position of the cam is near 210 degrees. FIGS. 16A and 16B are views of states of the cam, the roller, the secondary-transfer opposing roller, and the secondary transfer roller when a rotation position of the cam is near 210 degrees. FIG. 17 is a perspective view of a state that the secondary-transfer opposing roller and the secondary transfer roller form a nipping portion when a rotation position of the cam is near 300 degrees. FIGS. 18A and 18B are views of states of the cam, the roller, the secondary-transfer opposing roller, and the secondary transfer roller when a rotation position of the cam is near 300 degrees.

In FIG. 8, a target rotation position of the secondary transfer roller 22 when stopping at a distance from a cam radius (distance between the outer circumferential surface at a position opposing or in contact with the follower and the rotation center of the cam) of the first cam 75, when the secondary transfer roller 22 is brought into contact with the intermediate transfer belt 20, is set as a reference. In FIG. 8, a distance of a reference cam radius in the vertical axis is 0 [mm], and an angle of a reference rotation position in the lateral axis is at 0 degree. In FIG. 8, an upper range shows separation, and a lower range shows abutting. In FIG. 8, at an upper side, the separation distance of the secondary transfer roller 22 from the intermediate transfer belt 20 becomes large. At a lower side, the pushing depth of the secondary transfer roller 22 into the intermediate transfer belt 20 increases.

As indicated by the cam line diagram in FIG. 8, the first cam and the second cam have regions in which the cam radius corresponds to the approaching operation, the contact operation, the pressing operation, and the separation operation, respectively. Further, the first cam and the second cam also have a separation maintaining region for maintaining a state of separation between the separation operation and the approaching operation, and an abutting maintaining region for maintaining a state of abutting between the pressing operation and the separation operation.

At a rotation position (0 degree to 30 degrees) of the first cam 75 in the separation maintaining region, a difference (hereinafter, referred to as a "cam distance") between the reference cam radius and a cam radius at a position opposing the follower is maintained at 1.0 mm. When a rotation position of the first cam 75 is at 0 degree, the intermediate transfer belt 20 and the secondary transfer roller 22 become in a separated state as shown in the perspective view of FIG. 9 and FIG. 10B. The first cam 75 and the first idle roller 22D are brought into contact with each other as shown in FIG. 10A. The first cam 75 is in a state of pressing down the first idle roller 22D.

Rotation of the first cam 75 progresses from the separation maintaining region. At a rotation position (30 degrees to 80 degrees) of the first cam 75 in the approach region corresponding to the approaching operation, the cam distance changes at a constant rate (change amount of cam distance/angle change amount) so that the cam distance decreases between 1.0 mm and 0.3 mm. When a rotation position of the first cam 75 is at 70 degrees, the intermediate transfer belt 20 and the secondary transfer roller 22 are separated but are in an approaching state as shown in the perspective view of FIG. 11 and FIG. 12B. The first cam 75 and the first idle roller 22D are brought into contact with each other as shown in FIG. 12A. The first cam 75 is in a state of pressing down the first idle roller 22D. In this region, a change rate of the cam distance is larger than that in the contact region corresponding to the contact operation described later, and the secondary transfer roller 22 moves fast toward the intermediate transfer belt 20.

Rotation of the first cam 75 progresses from the approach region. At a rotation position (80 degrees to 200 degrees) of the first cam 75 in the contact region corresponding to the contact operation, the cam distance changes at a constant rate so that the cam distance decreases between +0.3 mm and −0.3 mm. When a rotation position of the first cam 75 is at 140 degrees, the intermediate transfer belt 20 and the secondary transfer roller 22 become in a contact state as shown in the perspective view of FIG. 13 and FIG. 14B. The first cam 75 and the first idle roller 22D are brought into contact with each other as shown in FIG. 14A. The first cam 75 is in a state of pressing down the first idle roller 22D. In this region, as compared with the approach region and a pressing region corresponding to the pressing operation described later, a change rate of the cam distance is small. The secondary transfer roller 22 moves slowly toward the intermediate transfer belt 20 (the secondary-transfer opposing roller 16). In this region, the front end of the cardboard P2 enters the secondary transfer nipping portion.

Rotation of the first cam 75 progresses from the contact region. At a rotation position (200 degrees to 270 degrees) of the first cam 75 in the pressing region corresponding to the pressing operation, the cam distance changes at a constant rate so that the cam distance decreases between −0.3 mm and −1.5 mm. When a rotation position of the first cam 75 is at 210 degrees, the intermediate transfer belt 20 and the secondary transfer roller 22 become in a state that a nipping portion is formed as shown in the perspective view of FIG. 15 and FIG. 16B. The first cam 75 and the first idle roller 22D are brought into contact with each other as shown in FIG. 16A. The first cam 75 is in a state of pressing down the first idle roller 22D. In this region, as compared with the contact region, a change rate of the cam distance is large. The secondary transfer roller 22 moves slowly toward the intermediate transfer belt 20 (the secondary-transfer opposing roller 16). Further, in this region, the nipping pressure of the secondary transfer nipping portion is increased to a predetermined nipping pressure (necessary nipping pressure). After the nipping pressure is increased to the predetermined nipping pressure, the front end of the image-forming region G of the cardboard P2 enters the secondary transfer nipping portion.

Rotation of the first cam 75 progresses from the pressing region. At a rotation position (270 degrees to 315 degrees) of the first cam 75 in the abutting maintaining region, the cam distance is maintained at −1.5 mm. When a rotation position of the first cam 75 is at 300 degrees, the intermediate transfer belt 20 and the secondary transfer roller 22 become in a state that a nipping portion is formed as shown in the perspective view of FIG. 17 and FIG. 18B. The first cam 75 and the first idle roller 22D are in a separated state as shown in FIG. 18A. In this region, the rear end of the image-forming region G of the cardboard P2 passes through the secondary transfer nipping portion.

Rotation of the first cam 75 progresses from the abutting maintaining region. At a rotation position (315 degrees to 340 degrees) of the first cam 75 in the separation region corresponding to the separation operation, the cam distance changes at a constant rate so that the cam distance increases between −1.5 mm and +1.0 mm. In this region, the rear end of the cardboard P2 passes through the secondary transfer nipping portion. Thereafter, a rotation position of the first cam 75 advances, and shifts to the separation maintaining region. Each time when the cardboard P2 is passed through as the sheet P, the above series of operation are repeated As described above, by setting constant the angular velocity of rotating the first cam 75 by forming the outer circumferential surface opposing the follower of the first cam 75 (the second cam 76), there can be set the moving velocity of the secondary transfer roller moving toward the intermediate transfer belt or separated from the intermediate transfer belt 20 corresponding to each operation. That is, by changing the cam radius of the first cam 75 for setting constant the angular velocity of rotation, the moving velocity of the secondary transfer roller toward the intermediate transfer member in the approaching operation, the contact operation, and the pressing operation can be changed. Therefore, it becomes possible to rotation-drive the first cam 75 by using the same driving source as that of the driving unit of the intermediate transfer belt 20 and the like. Consequently, it becomes possible to make compact the image forming apparatus such as the image forming apparatus 500 and reduce cost by decreasing the exclusive driving source of the cam driving motor 79 and the like.

On the other hand, in a case where the exclusive cam driving motor 79 is used as described above, the rotation position of rotating the first cam 75 and the angular velocity of rotation can be highly-accurately controlled, by using a motor such as a stepping motor. By highly-accurately controlling the rotation position and the angular velocity in this way, it becomes possible to highly-accurately control a change amount per unit time of the radius of the cam that is brought into contact with the first idle roller 22D as the follower, and highly-accurately control the moving velocity of a secondary transfer roller such as the secondary transfer roller 22. Therefore, a moving velocity of the secondary transfer roller 22 as a target can be easily obtained.

EXAMPLE 2

Figure 19:
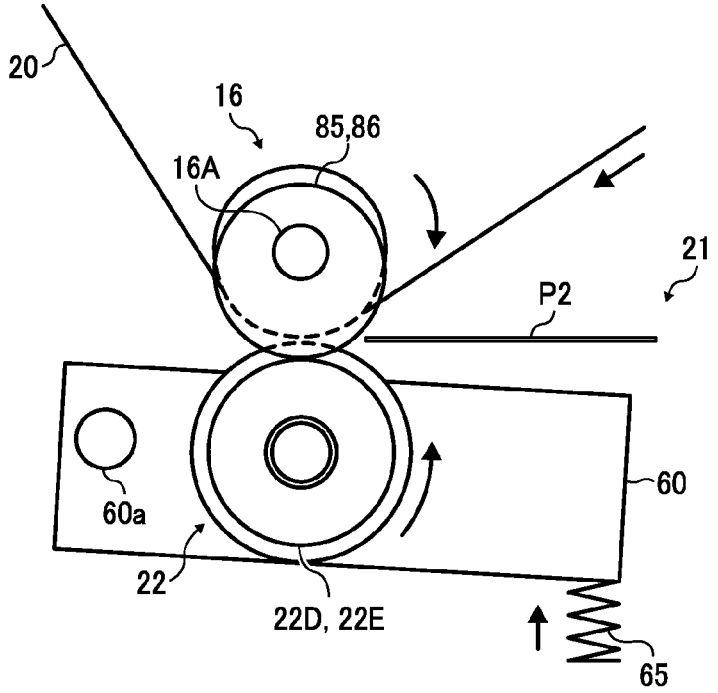
FIG. 19 is a schematic view of a state of the secondary transfer nipping portion immediately before making a cardboard enter according to Example 2.

Next, Example 2 of the secondary transfer device 21 according to Embodiment 1 will be described with reference to drawings. The secondary transfer device 21 of the present example and the secondary transfer device 21 of Example 1 are different in only the angular velocity of rotating cams provided in the moving unit and shapes of the cams. Therefore, a description of the operation of a configuration similar to that of the secondary transfer device 21 in Example 1 will be appropriately omitted. FIG. 19 is a schematic view of a state of the secondary transfer nipping portion immediately before the cardboard P2 is made to enter according to the present example.

As shown in FIG. 19, according to the secondary transfer device 21 in the present example, the cams held in the moving unit that moves the secondary transfer roller 22 to be contacted to and separated from the intermediate transfer belt 20 are eccentric cams having simple shapes different from the shapes of the first cam 75 and the second cam 76 in Example 1. Specifically, in place of the first cam 75 and the second cam 76 in Example 1, a first eccentric cam 85 and a second eccentric cam 86 as circular plate cams are fixed eccentrically in both end regions in the longitudinal direction of the penetrating shaft member 16A as the rotary shaft of the secondary-transfer opposing roller 16. Therefore, by controlling the angular velocity for rotating the penetrating shaft member 16A by the cam driving motor 79 formed of a stepping motor described with reference to FIG. 3 in Example 1, a change amount per unit time of the cam radius of the first eccentric cam 85 and the second eccentric cam 86 that are brought into contact with the follower is changed. By changing the change amount per unit time of the cam radius of the first eccentric cam 85 and the second eccentric cam 86 in this way, the moving velocity of the secondary transfer roller 22 toward the intermediate transfer member in the approaching operation, the contact operation, and the pressing operation described with reference to FIG. 6 and FIG. 7 in Example 1 can be changed.

By configuring the moving unit of the secondary transfer device 21 in this way, it is difficult to rotation-drive the eccentric cams 85 and 86 by using the same driving source as that of the driving unit of the intermediate transfer belt 20 and the like, like the configuration in Example 1. However, other work effects of Example 1 can be similarly exerted. In addition, by using the cam driving motor 79 formed of the stepping motor, the moving velocity of a targeted cam driving motor can be easily obtained. Therefore, the cost of cams can be reduced by using cams with a simple shape such as the eccentric cams 85 and 86.

Since the image forming apparatus 500 according to Embodiment 1 includes any one of the secondary transfer devices 21 in each example, the image forming apparatus 500 can exert similar effects of the secondary transfer devices 21 in each example.

In Embodiment 1, there has been described the configuration of operating the moving unit of the secondary transfer device 21 when passing a cardboard through, and repeating the operation of contacting and separating the secondary transfer roller 22 to and from the intermediate transfer belt. However, the present invention is not limited to this configuration. The present invention can be also applied, for example, to a configuration of separating the secondary transfer roller from the intermediate transfer belt at the image-forming waiting time and in the adjustment operation inside the image forming apparatus 500, and abutting the secondary transfer roller against the intermediate transfer belt at a return time, regardless of a thickness of the sheet that is passed through. More specifically, the present invention can be also applied to the secondary transfer device of a configuration that the secondary transfer roller moves from a state of being separated from the intermediate transfer belt to a state of being abutted against the intermediate transfer belt, at a fast print time on the regular paper, and the like. Although it is difficult to take balance with a higher speed of the image forming apparatus, when passing a regular paper through, it is also possible to reduce oscillation when the regular paper enters the secondary transfer nipping portion, and achieve higher image quality, by repeating the contact and separating operation of the secondary transfer roller to and from the intermediate transfer belt.

There has been described an example that the present invention is applied to the secondary transfer device 21 of a configuration having the secondary transfer roller 22 directly abutted against the intermediate transfer belt 20 to form the secondary transfer nipping portion. However, the present invention is not limited to such a configuration. The present invention can be also applied, for example, to a secondary transfer device of a configuration that a secondary transfer roller of a secondary transfer device including a plurality of support and conveyance rollers, transfer and conveyor belts, and secondary transfer rollers is abutted against the intermediate transfer belt via the transfer and conveyer belts to form a secondary transfer nipping portion. Further, there has been described a configuration using cams such as the first cam 75 and the first eccentric cam 85 as the moving unit that moves the secondary transfer roller 22. However, the present invention is not limited to such a configuration. The present invention can be also applied, for example, to a configuration using a stepping motor and a solenoid for the driving source of a linking assembly.

In Embodiment 1, there has been described an example of the present invention being applied to the secondary transfer device 21 of the image forming apparatus 500 as an intermediate-transfer system image forming apparatus including the intermediate transfer belt 20 as an intermediate transfer member. However, the present invention is not limited to such a configuration. There is also a similar problem in the apparatus called a direct-transfer-system image forming apparatus that includes an image carrier such as a photoconductor drum carrying a toner image on the surface and the transfer roller, and that transfers the toner image carried on the image carrier to the recording medium which enters the transfer nipping portion between the image carrier and the transfer roller. The present invention can be also applied to the direct-transfer-system image forming apparatus. By applying the present invention, it is possible to provide a transfer device that can reduce the impact when making the recording medium enter the transfer nipping portion, and can suppress image quality reduction such as shock jitter compared to a conventional practice. By including the transfer device, it is possible to provide a direct-transfer-system image forming apparatus that can reduce the impact when making the recording medium enter the transfer nipping portion, and can suppress image quality reduction such as shock jitter compared to a conventional practice.

(Embodiment 2) Hereinafter, an image forming apparatus according to a second embodiment (hereinafter, referred to as "Embodiment 2") of the present disclosure will be described. The image forming apparatus 500 as an image forming apparatus according to Embodiment 2 is different from the image forming apparatus according to Embodiment 1 in only the following points, and other configurations are similar to those of the image forming apparatus according to Embodiment 1. Therefore, description of a total configuration and operations of the image forming apparatus 500 in Embodiment 2 will be omitted. Configurations and work effects similar to those in Embodiment 1 will be appropriately omitted. Configuration members that achieve similar functions and configuration members identical to those of the configuration members of the image forming apparatus in Embodiment 1 will be described by assigning identical reference symbols, except where particular distinction is necessary.

The image forming apparatus 500 according to Embodiment 2 is different from the image forming apparatus according to Embodiment 1 in the following points. To spread a nip width of the secondary transfer nipping portion to an upstream side of a sheet conveyance direction, there is provided a press-down roller 91 for pressing down the intermediate transfer belt 20 from an inner circumferential surface side toward an outer circumferential surface side near the upstream side of the secondary-transfer opposing roller 16 in the moving direction of the intermediate transfer belt 20. Further, a guide unit that guides the sheet P entering the secondary transfer nipping portion is provided. The moving unit of the secondary transfer roller 22 is configured to press down the secondary transfer roller 22 in a predetermined range when the rear end of the sheet P passes through the guide unit. The different points of Embodiment 2 from Embodiment 1 will be described below with reference to drawings.

Figure 20:
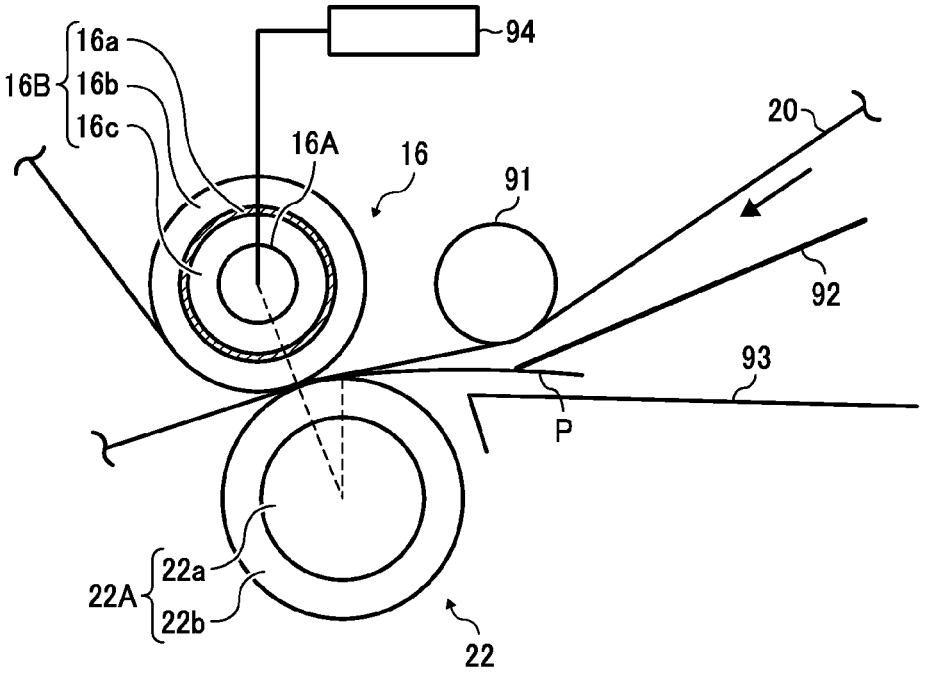
FIG. 20 is a view of a secondary transfer device and a surrounding configuration thereof according to Embodiment 2.

First, there will be described the provision of the press-down roller 91 that presses down the intermediate transfer belt 20 from an inner circumferential surface side toward an outer circumferential surface side near the upstream side of the secondary-transfer opposing roller 16 in the moving direction of the intermediate transfer belt 20. FIG. 20 is a view of the secondary transfer device 21 and a surrounding configuration thereof according to Embodiment 2. When a toner image on the intermediate transfer belt 20 as an image carrier is secondarily transferred onto the sheet P as a recording medium, an electric discharge occurs between the sheet P near the entrance of the secondary transfer nipping portion and the intermediate transfer belt 20. Consequently, an abnormal image called a transfer dust or a transfer variation occasionally occurs.

As a configuration for suppressing such an abnormal image, there is known a configuration having a guide member provided that guides the sheet toward the secondary transfer nipping portion while guiding the sheet so as not to be in contact with the toner image on the intermediate transfer belt on the upstream side of the secondary transfer nipping portion. Further, there is also known a configuration for making it possible to displace a press-down roller that pressurizes the intermediate transfer belt from the inner circumferential side toward the outer circumferential side of the intermediate transfer belt, and for displacing the press-down roller in a sheet conveyance direction at a timing when a sheet rear-end passes through a downstream-side end (hereinafter, referred to as a "front end") of the guide member. For example, the following configuration is proposed to satisfactorily suppress a toner image disturbance generated by the impact of collision between a sheet and the intermediate transfer belt, when the rear end of the sheet passes through the front end of the guide member that guides the sheet to the secondary transfer nipping portion. The press-down roller that presses down the intermediate transfer belt from the inner circumferential side is provided so that the press-down roller can be displaced in the pressing direction. The press-down roller is controlled to be displaced at a timing when the rear end of the sheet passes through the front end of the guide member. By pressing down the intermediate transfer belt in this way, it is possible to suppress an abnormal image of a transfer dust and a transfer variation that occurs due to the approach of the intermediate transfer belt to the sheet near the entrance of the secondary transfer nipping portion.

According to a conventional configuration of making displaceable the press-down roller which presses down the intermediate transfer belt from the inner circumferential side and displacement-controlling at a timing when the rear end of the sheet passes through the front end of the guide member, however, the following inconvenience occasionally occurred. When displacing the press-down roller in the pressing direction, tension of the intermediate transfer belt rapidly changes, and oscillation occurs in the intermediate transfer belt. Consequently, an abnormal image different from the transfer dust occurs. Therefore, in Embodiment 2, the secondary transfer device 21 is configured as follows in order to provide the secondary transfer device 21 that can suppress an abnormal image of a transfer dust and a transfer variation that occurs due to the approach of the intermediate transfer belt 20 to the sheet P near the entrance of the secondary transfer nipping portion.

As shown in FIG. 20, the secondary transfer roller 22 includes the cylindrical hollow metal core 22*a*, and the elastic layer 22*b* made of a conductive elastic member and fixed to a circumferential surface of the hollow metal core 22*a*. The secondary-transfer opposing roller 16 arranged to oppose the secondary transfer roller 22 includes the cylindrical hollow metal core 16*a* made of metal and the elastic layer 16*b* made of a conductive elastic member and fixed to a circumferential surface of the hollow metal core 16*a*. The secondary transfer roller 22 is pressed against the secondary-transfer opposing roller 16 via the intermediate transfer belt 20 to form the secondary transfer nipping portion.

There is provided an upper guide member 92 as a guide member that guides the sheet P to the secondary transfer nipping portion in contact with the sheet P from above in FIG. 20 so that a toner image on the intermediate transfer belt 20 and the sheet P are not in contact for a long time on the upstream side of the secondary transfer nipping portion in the sheet conveyance direction. The upper guide member 92 is provided on the upstream side of the secondary transfer nipping portion in the sheet conveyance direction. There is also provided a lower guide member 93 that is held by the roller unit holder 60 of the secondary transfer device 21 and that guides the sheet P to the secondary transfer nipping portion in contact with the sheet P from below in FIG. 20. In Embodiment 2, the upper guide member 92 is supported by a support-side plate of the secondary transfer device 21. However, the present invention is not limited to such a configuration, and the upper guide member 92 may be supported by a support plate and the like of the apparatus body 100.

When a secondary transfer bias is applied to the penetrating shaft member 16A of the secondary-transfer opposing roller 16 from a high-voltage power source 94, a secondary transfer current flows between the penetrating shaft member 16A and the secondary transfer roller 22 that is grounded, via the intermediate transfer belt 20. The secondary transfer current flows mainly in a path connecting between axes of the rotary shafts of the both rollers. A secondary transfer of the toner image from the intermediate transfer belt 20 to the sheet P is performed at a position (hereinafter, referred to as a "inter-axial position") where the axes of the rotary shafts of the both rollers are connected to each other. At a slight upstream side of the inter-axial position in the moving direction of the intermediate transfer belt 20, an electric discharge occurs in a space (hereinafter, referred to as a "gap") that is formed between the surface of the intermediate transfer belt 20 and the secondary transfer roller 22. Consequently, a toner in the toner image carried in the region of the intermediate transfer belt 20 before entering the secondary transfer nipping portion is dispersed, and a transfer dust occurs.

Therefore, in Embodiment 2, on the upstream side of the inter-axial position in the belt moving direction, the intermediate transfer belt 20 is forcibly wound around the secondary transfer roller 22 so that the gap is formed at a relatively separated position from the inter-axial position. The forcible winding is performed by the press-down roller 91 arranged on the upstream side of the secondary-transfer opposing roller 16 in the belt moving direction on the inner circumferential side of the intermediate transfer belt 20. By arranging such that the press-down roller 91 presses down the intermediate transfer belt 20 from the inner circumferential side of the intermediate transfer belt 20 toward the secondary transfer roller 22, the intermediate transfer belt 20 is forcibly wound around the secondary transfer roller 22. By this winding, the intermediate transfer belt 20 and the secondary transfer roller 22 form a pre-nipping portion, at the upstream of the secondary transfer nipping portion by the secondary transfer roller 22 and the secondary-transfer opposing roller 16 in the belt moving direction of the intermediate transfer belt 20. As a result, the secondary transfer nipping portion is widened to the upstream side in the belt moving direction.

By forming the pre-nipping portion to set the gap (the space) far from a position of a reach of the secondary transfer current, occurrence of the transfer dust is effectively suppressed. When the rear end of the sheet P passes through the front end of the upper guide member 92, the sheet P approaches the intermediate transfer belt 20 by restoring force, and the transfer dust is generated by the electric discharge due to the fine gap. Therefore, the secondary transfer device 21 according to Embodiment 2 is configured to suppress the transfer dust by pressing down the secondary transfer roller 22 by an arbitrary amount at the rear end of the sheet P, as described later.

Figure 21:
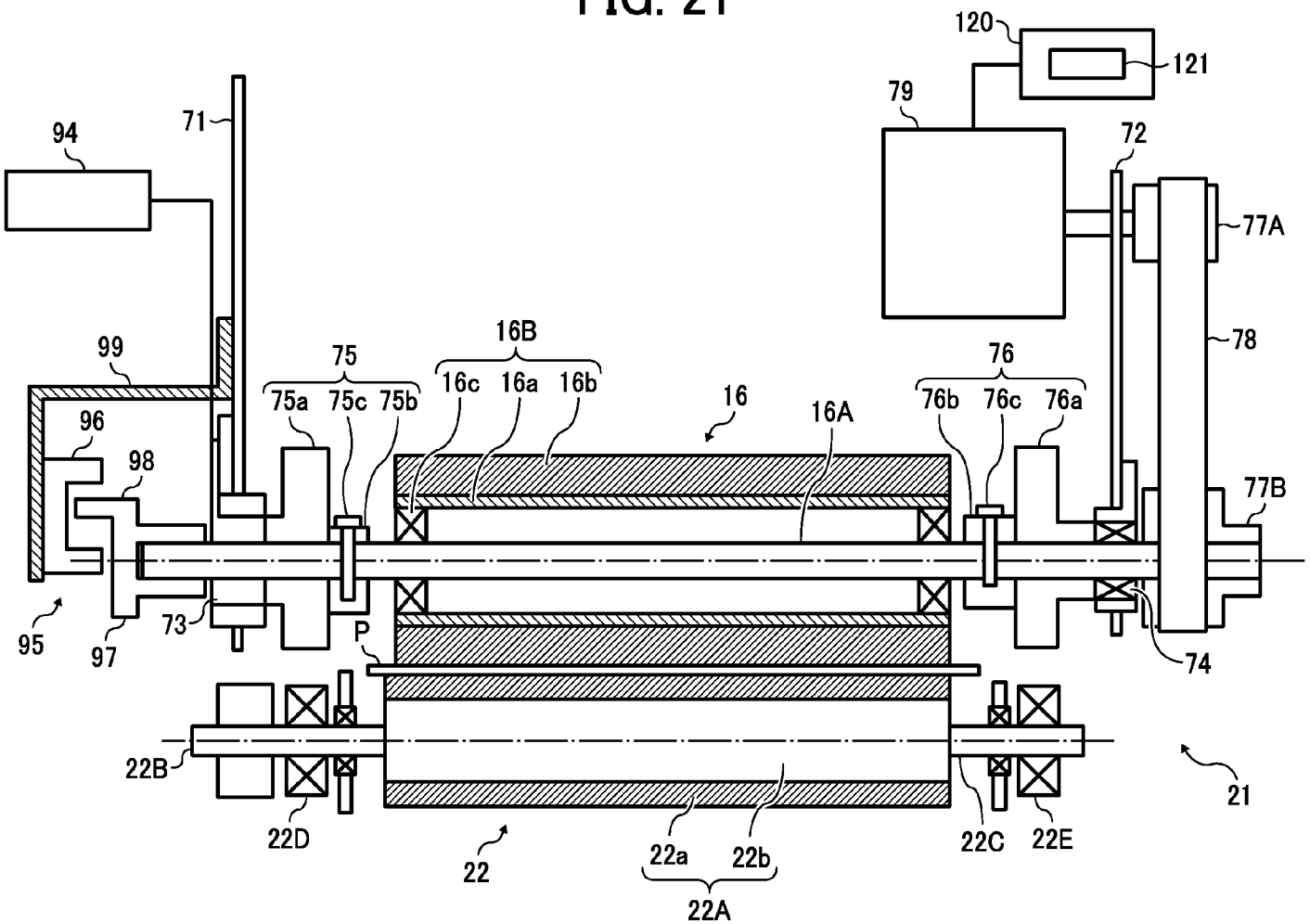
FIG. 21 is a cross-sectional view of a moving assembly of a secondary transfer roller held by the secondary transfer device according to Embodiment 2.

Next, main configuration members of the secondary transfer device 21 according to Embodiment 2 will be described in more detail with reference to FIG. 21. FIG. 21 is a cross-sectional view of a moving unit of the secondary transfer roller 22 held by the secondary transfer device 21. In FIG. 21, the secondary transfer roller 22 includes a roller portion 22A, a first shaft member 22B and a second shaft member 22C that are stretched from both end surfaces of the roller 22A in an axial direction and extended to a rotation axial direction, and a first idle roller 22D and a second idle roller 22E that function as a follower described later. The roller portion 22A includes a cylindrical hollow metal core 22*a* and an elastic layer 22*b* made of an elastic member and fixed to a circumferential surface of the hollow metal core 22*a*.

As metals that configure the hollow metal core 22*a*, there can be exemplified stainless steel and aluminum. However, materials of the hollow metal core 22*a* are not limited to these materials. The elastic layer 22*b* is desirably at 70° or below in JIS-A hardness. In a case where the cleaning blade not shown in FIG. 21 is abutted against the secondary transfer roller 22, various problems occur when the elastic layer 22*b* is too soft. Therefore, the elastic layer 22*b* is desirably at 40° or above in JIS-A hardness. When the secondary transfer roller 22 does not have a cleaning blade, the elastic layer 22*b* can be set soft. By softening the elastic layer 22*b*, an abnormal image due to the impact when the sheet P rushes into and gets out of the secondary transfer nipping portion can be reduced.

Therefore, the elastic layer 22*b* is desirably at about 40° to 50° in Asker-C hardness. In the elastic layer 22*b* of the secondary transfer roller 22, as a rubber material exerting conductivity, there may be used conductive epichlorohydrin rubber, EPDM and Si rubber dispersed with carbon, and NBR, urethane rubber, and the like having an ion conductive function. The elastic layer 22*b* fixed onto the circumferential surface of the hollow metal core 22*a* is configured by a conductive rubber material of which a resistance value is adjusted to exerts a resistance about 7.5 Log Ω.

The electric resistance of the elastic layer 22*b* is adjusted to a predetermined range to prevent the occurrence of the following inconvenience when using the sheet P of which a size in a roller axis line direction is relatively small like the A5 size. The inconvenience is that a transfer current is concentrated on a portion where the intermediate transfer belt 20 and the secondary transfer roller 22 are in direct contact with each other without via the recording sheet in the secondary transfer nip. By setting an electric resistance of the elastic layer 22*b* to a value larger than the resistance of the sheet P, concentration of the transfer current can be suppressed.

As a conductive rubber material configuring the elastic layer 22*b*, foamed rubber is used to exert elasticity of about 40° to 50° in Asker-C hardness. By configuring the elastic layer 22*b* by such foamed rubber, it is possible to form a secondary transfer nipping portion having a certain level of width in the sheet conveyance direction by flexibly deforming the elastic layer 22*b* in a thickness direction in the secondary transfer nipping portion. The elastic layer 22*b* has a drum shape that has a larger outer diameter of the center part than an outer diameter of both end parts. By providing such a drum shape, when forming the secondary transfer nipping portion by biasing the secondary transfer roller 22 toward the intermediate transfer belt 20 by the bias coil spring 65 (see FIG. 22), occurrence of a distortion that reduces a pressure of the center part can be also prevented. The secondary transfer roller 22 of the above configuration is biased by the bias force of the bias coil spring 65 toward the intermediate transfer belt 20 that is wound around the secondary-transfer opposing roller 16.

The secondary-transfer opposing roller 16 wound with the intermediate transfer belt 20 includes a roller portion 16B as a cylindrical body, and a penetrating shaft member 16A that penetrates a rotation center portion of the roller portion 16B in the rotation axial direction and that also makes the roller portion 16B turn idly on the surface of penetrating shaft member 16A. The penetrating shaft member 16A is made of a metal, and makes the roller portion 16B rotate idly freely on the circumferential surface of the penetrating shaft member 16A. The roller portion 16B as a body includes a hollow metal core 16*a* in a drum shape, an elastic layer 16*b* made of an elastic member and fixed on the circumferential surface of the hollow metal core 16*a*, and ball bearings 16*c* pressurized into both ends of the hollow metal core 16*a* in the axial direction. The ball bearing 16*c* rotates on the penetrating shaft member 16A together with the hollow metal core 16*a* while supporting the hollow metal core 16*a*. The elastic layer 16*b* is formed on the outer circumferential surface of the hollow metal core 16*a*.

The penetrating shaft member 16A is rotatably supported by a first bearing 73 fixed to a first side plate 71 of a belt unit that tensions the intermediate transfer belt 20, and a second bearing 74 fixed to a second side plate 72. However, except when a first cam 75 and a second cam 76 described later are rotated, the cams are stationary without being rotation-driven during the most of the image forming operation. The roller portion 16B that attempts to rotate following the endless movement of the intermediate transfer belt 20 is made to rotate idly freely on the circumferential surface of the penetrating shaft member 16A. The elastic layer 16*b* fixed onto the circumferential surface of the hollow metal core 16*a* is configured by an EP rubber material having a resistance value equal to or below 6.0 Log Ω. As a rubber material configuring the elastic layer 16*b*, an EP rubber is used to exert elasticity of about 70° in JIS-A hardness.

In the penetrating shaft member 16A of the secondary-transfer opposing roller 16, out of a total region in the longitudinal direction, in both end regions not positioned in the roller portion 16B, cams as abutting members abutted against the secondary transfer roller 22 are fixed to rotate integrally with the penetrating shaft member 16A. Specifically, the first cam 75 is fixed to one end part region in the longitudinal direction of the penetrating shaft member 16A. In the first cam 75, mainly a cam portion 75*a* and a roller portion 75*b* in a perfect circular shape are integrally formed by being arrayed in the axial direction. The screw 75*c* penetrating the roller portion 75*b* is meshed with the penetrating shaft member 16A to fix the first cam 75 to the penetrating shaft member 16A. The second cam 76 in a similar configuration to that of the first cam 75 is fixed in the other end region in the longitudinal direction of the penetrating shaft member 16A.

A drive receiving pulley 77B is fixed in an outer region of the second cam 76 in the axial direction of the penetrating shaft member 16A. A disk to be detected 97 is fixed to an outer region of the first cam 75 in the axial direction of the penetrating shaft member 16A. On the other hand, the cam driving motor 79 is fixed to the second side plate 72 of the belt unit. The drive output pulley 77A fixed to the motor shaft of the cam driving motor 79 is rotated. Driving force is transmitted to the drive receiving pulley 77B via the timing belt 78. In the above configuration, by driving the cam driving motor 79, the penetrating shaft member 16A can be rotated. At this time, even when the penetrating shaft member 16A is rotated, the roller portion 16B can be rotated idly freely on the penetrating shaft member 16A. Therefore, rotation of the roller portion 16B following the intermediate transfer belt 20 is not interrupted.

By using a stepping motor as the cam driving motor 79, a rotation angle of the cam driving motor 79 can be freely set without providing a rotation-angle detector such as encoder and the like. When the penetrating shaft member 16A stops the rotation at a predetermined rotation angle, the cam portions of the first cam 75 and the second cam 76 are respectively abutted against the first idle roller 22D and the second idle roller 22E arranged on the axis of the secondary transfer roller 22. The secondary transfer roller 22 is pressed back against the bias force of the bias coil spring 65 that biases the roller unit holder 60 (see FIG. 22) upward. Accordingly, by moving the secondary transfer roller 22 in a direction away from the secondary-transfer opposing roller 16 (eventually, the intermediate transfer belt 20), the inter-axial (rotary shaft) distance between the secondary-transfer opposing roller 16 and the secondary transfer roller 22 is adjusted.

In the above configuration, the moving unit that moves the secondary transfer roller 22 to the intermediate transfer belt 20 is configured by the first cam 75, the second cam 76, the cam driving motor 79, the roller unit holder 60, and the like. That is, a distance adjuster that adjusts the distance between the secondary-transfer opposing roller 16 and the secondary transfer roller 22 is configured. Then, the secondary-transfer opposing roller 16 as a rotatable rotary support member makes the roller portion 16B rotate idly freely on the penetrating shaft member 16A that penetrated the cylindrical roller portion 16B. When the penetrating shaft member 16A is rotated, the first cam 75 and the second cam 76 fixed respectively to the vicinity of the both ends in the axial direction of the penetrating shaft member 16A rotate integrally. Accordingly, as shown in FIG. 21, by providing, at only one end side in the axial direction, the drive transmission assembly for transmitting the drive to the penetrating shaft member 16A, it is possible to rotate the first cam 75 and the second cam 76 respectively provided near both end sides.

In Embodiment 2, the hollow metal core 22*b* of the secondary transfer roller 22 is grounded. On the other hand, a secondary transfer bias of the same polarity as that of the toner is applied to the hollow metal core 16*a* of the secondary-transfer opposing roller 16. Accordingly, in the secondary transfer nipping portion, a secondary transfer electric field for electrostatically moving the toner from the secondary-transfer opposing roller 16 side (the intermediate transfer belt 20) toward the secondary transfer roller 22 side is formed between the both rollers.

The ball bearing 16*c* that rotatably receives the metal-made penetrating shaft member 16A of the secondary-transfer opposing roller 16 is made of metal, and has conductivity. The first bearing 73 that makes the penetrating shaft member 16A, supporting the secondary-transfer opposing roller 16 via the ball bearing 16*c*, rotatably supported by the first side plate 71 is formed of a conductive sliding bearing. The high-voltage power source 94 that outputs the secondary transfer bias is connected to the conductive first bearing 73. By providing the above configuration, the secondary transfer bias that is output from the high-voltage power source 94 is guided to the secondary-transfer opposing roller 16 via the conductive first bearing 73. In the secondary-transfer opposing roller 16, the secondary transfer bias is sequentially transmitted to the metal-made penetrating shaft member 16A, the ball bearings 16*c* made of metal, the hollow metal core 16*a* made of metal, and the elastic layer 16*b* having conductivity.

The disk 97 to be detected of the cam angle detector 95 that detects rotation angle positions of the cams 75 and 76 fixed to one end of the left side of the penetrating shaft member 16A in FIG. 21 has a portion 98 to be detected that rises in the axial direction at a predetermined position in the rotation direction of the penetrating shaft member 16A. On the other hand, an optical sensor 96 is fixed to a sensor bracket 99 fixed to the first side plate 71 of the belt unit. In the process of rotation of the penetrating shaft member 16A, when the penetrating shaft member 16A is positioned in a predetermined rotation angle range, the portion 98 to be detected of the disk 97 to be detected enters between a light emitting element and a light receiving element of the optical sensor 96, and interferes the optical path between the light emitting element and the light receiving element. The light receiving element of the optical sensor 96 receives light from the light emitting element, and transmits a light reception signal to a controller. The controller accepts a rotation angle position of the cam portions of the first cam 75 and the second cam 76 fixed to the penetrating shaft member 16A, based on a timing of the light reception signal from the light receiving element being stopped, and based on a drive amount of the cam driving motor 79 from this timing.

The first cam 75 and the second cam 76 are abutted, at the predetermined rotation angle, against the first idle roller 22D and the second idle roller 22E arranged on the axis of the secondary transfer roller 22. Then, the secondary transfer roller 22 is pressed back (hereinafter, the press back will be referred to as "press down") in a direction away from the secondary-transfer opposing roller 16 against the bias force of the bias coil spring 65. As a result, a distance between the rotary shaft of the secondary-transfer opposing roller 16 and the rotary shaft of the secondary transfer roller 22 increases. A press-back amount (hereinafter, referred to as a "press-down amount") is determined by the rotation angle position of the first cam 75 and the second cam 76. When the press-down amount of the secondary transfer roller 22 becomes larger, an inter-axis distance between the secondary-transfer opposing roller 16 and the secondary transfer roller 22 becomes larger. The operation of changing the rotation position of the first cam 75 and the second cam 76 to increase the distance between the rotary shaft of the secondary-transfer opposing roller 16 and the rotary shaft of the secondary transfer roller 22 will be referred to as a press-down operation.

In the first shaft member 22B of the secondary transfer roller 22, the first idle roller 22D is provided to be able to rotate idly. The first idle roller 22D is a ball bearing of which an outer diameter is slightly smaller than that of the secondary transfer roller 22, and which can rotate idly on the circumferential surface of the first shaft member 22B. On the other hand, in the second shaft member 22C of the secondary transfer roller 22, the second idle roller 22E having a similar configuration to that of the first idle roller 22D is provided to be able to rotate idly. As described above, the first cam 75 and the second cam 76 fixed to the penetrating shaft member 16A of the secondary-transfer opposing roller 16 are set to be abutted against the first idle roller 22D and the second idle roller 22E at a predetermined rotation angle position.

Specifically, the first cam 75 fixed to the vicinity of one end side of the penetrating shaft member 16A is abutted against the first idle roller 22D of the secondary transfer roller 22. At this time, the second cam 76 fixed to the vicinity of the other end side of the penetrating shaft member 16A is simultaneously abutted against the second idle roller 22E of the secondary transfer roller 22. The idle rollers 22D and 22E abutted against by the first cam 75 and the second cam 76 fixed to the penetrating shaft member 16A of the secondary-transfer opposing roller 16 are blocked to rotate following the abutting. However, the rotation of the secondary transfer roller 22 is not interrupted by the block. This is because the idle rollers 22D and 22E are ball bearings, even when the idle rollers 22D and 22E stop rotating, the shaft members 22B and 22C of the secondary transfer roller 22 can rotate freely independently of the idle rollers 22D and 22E. By stopping the rotation of the idle rollers 22D and 22E following the abutting by the cams 75 and 76, occurrence of sliding friction between the cams and the idle rollers can be avoided. Further, occurrence of increase in the torque, due to the sliding friction, of the driving motor that rotation-conveys the intermediate transfer belt 20 and the driving motor of the secondary transfer roller 22 can be also avoided.

Figure 22:
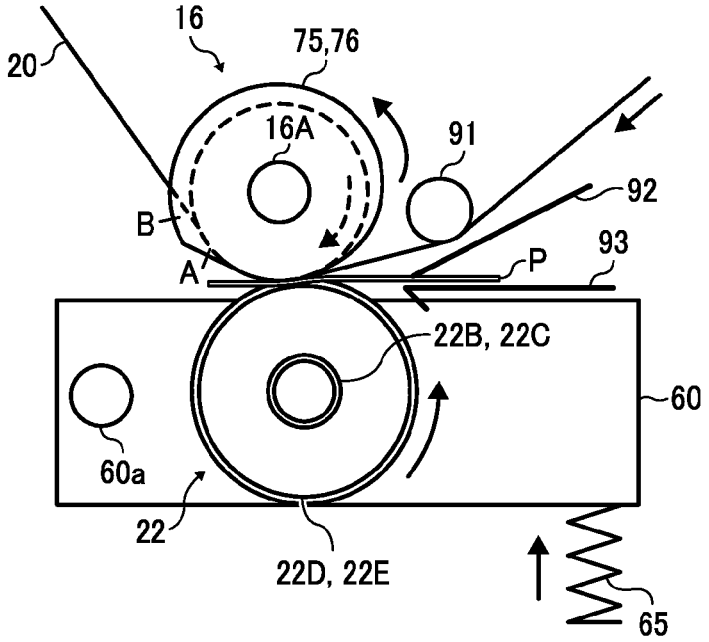
FIG. 22 is a view of a secondary transfer performed while guiding a sheet by an upper guide member.
Figure 23:
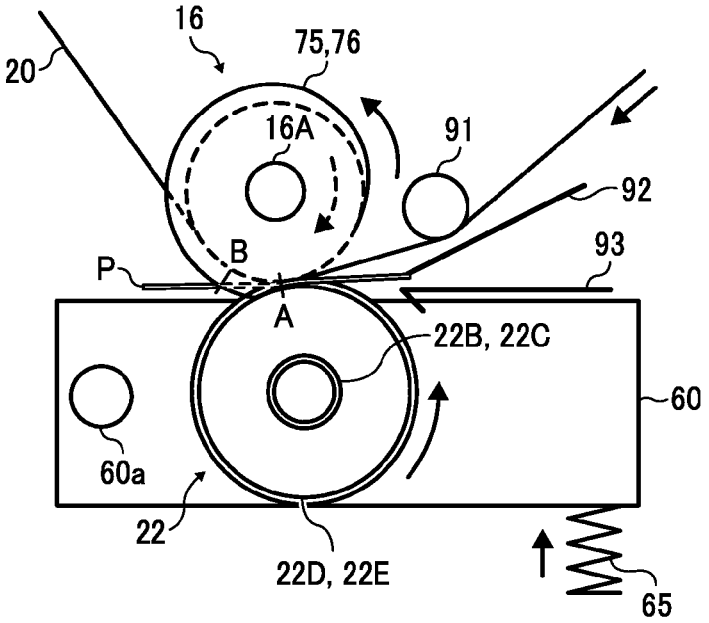
FIG. 23 is a view of a timing when a rear end of the sheet passes through a front end of the upper guide member.
Figure 24:
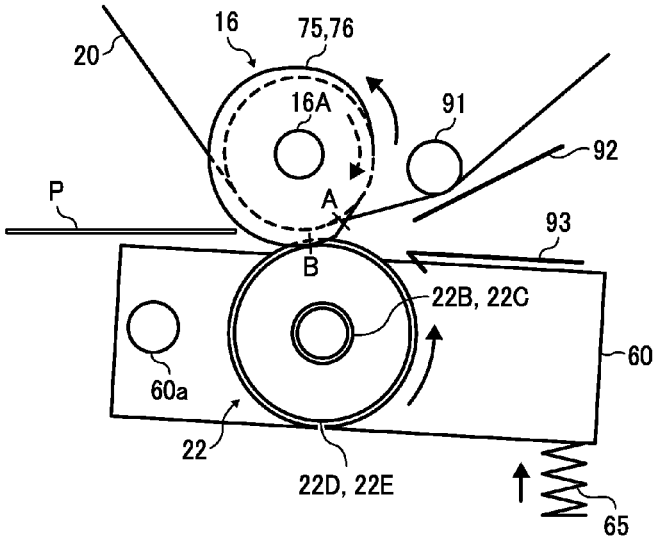
FIG. 24 is a view after the rear end of the sheet passed through the secondary transfer nipping portion.
Figure 25:
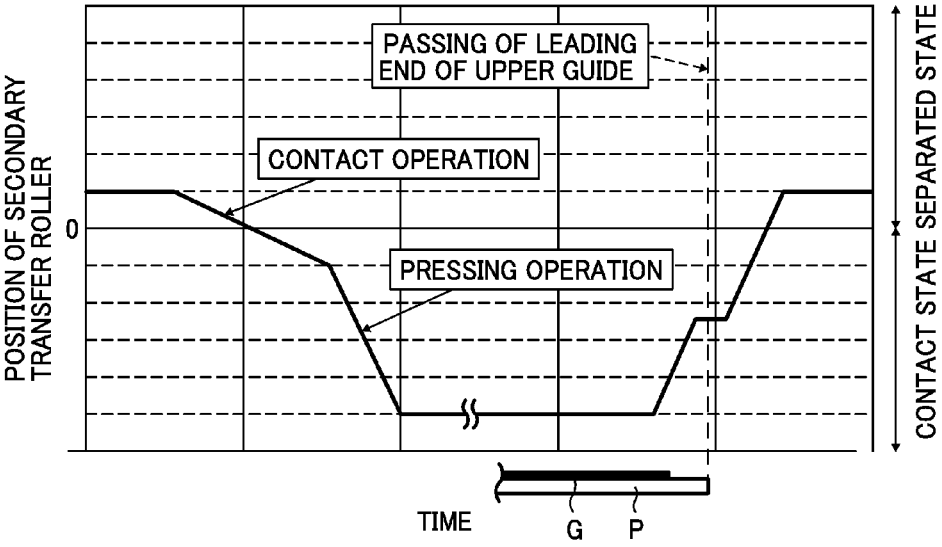
FIG. 25 is a timing chart of movement of a secondary-transfer roller position and passing of a sheet through the front end of the upper guide member in the case of performing a press-down operation when the rear end of the sheet passes through the front end of the upper guide member, when an abutting operation is divided into a contact operation and a pressing operation.

Next, the press-down operation performed when the rear end of the sheet P passes through the front end of the upper guide member 92 by the secondary transfer device 21 according to Embodiment 2 will be described with reference to drawings. FIG. 22 is a view of a secondary transfer performed while guiding the sheet P by the upper guide member 92. FIG. 23 is a view of a timing when the rear end of the sheet P passes through the front end of the upper guide member. FIG. 24 is a view after the rear end of the sheet P passed through the secondary transfer nipping portion. FIG. 25 shows an example of timings of movement of a position of the secondary-transfer roller 22 and passing of the sheet P through the front end of the upper guide member 92 in the case of performing a press-down operation when the rear end of the sheet P passes through the front end of the upper guide member 92, when the abutting operation is divided into a contact operation and a pressing operation.

As shown in FIG. 22, when a secondary transfer is performed while guiding the sheet P by the upper guide member 92 (at a normal printing time), the cams 75 and 76 provided in the secondary-transfer opposing roller 16 and the idle rollers 22D and 22E of the secondary transfer roller 22 are in a separated state. Then, all the bias force by the bias coil spring 65 as the biasing unit is added to each member constituting the secondary transfer nipping portion and the sheet P, so that the final nipping pressure is generated.

Thereafter, as shown in FIG. 23, at the timing of the rear end of the sheet P passing through the front end of the upper guide member 92, the cams 75 and 76 provided in the secondary-transfer opposing roller 16 are abutted against the idle rollers 22D and 22E of the secondary transfer roller 22 at a cam position A indicated by A in FIG. 23. Then, the rotation of the penetrating shaft member 16A of the secondary-transfer opposing roller 16 is stopped. Alternatively, a constant press-down amount may be secured, by providing a cam portion having the same radius as that of the cam position A in each of the cams 75 and 76, and by keeping the cams rotated. The press-down amount of the secondary transfer roller 22 pressed down at the cam position A is set at a level of generating a nipping pressure not generating clear aggravation of the secondary transfer and capable of securing transferability. For example, when the axial center position of the secondary transfer roller 22 in the normal print state is 0, the secondary transfer roller 22 can be pressed down by about 0.5 mm to 1.5 mm.

The press-down amount of the secondary transfer roller 22 by abutting the cams 75 and 76 against the idle rollers 22D and 22E can be arbitrarily set by changing the rotation stop position of the cams 75 and 76. For this purpose, in the secondary transfer device 21 in Embodiment 2, a secondary transfer controller 120 that controls the cam driving motor 79 and the like by communicating with an apparatus-body controller 110 provided in the apparatus body 100 has a sheet information obtainer 121 as a recording-medium information obtainer. The press-down amount of the secondary transfer roller 22 can be arbitrarily set by changing the rotation stop position of the cams 75 and 76 according to information of a type of sheet and a sheet thickness of the sheet P obtained from the body controller 110 by the sheet information obtainer 121. That is, the transfer device can change an amount of increasing a distance between an axial center of the penetrating shaft member 16A of the secondary-transfer opposing roller 16 and an axial center of the first shaft member 22B and the second shaft member 22C of the secondary transfer roller 22 by changing the rotation stop position of the cams 75 and 76, according to one or both of a type of sheet and a sheet thickness of the sheet P. In Embodiment 2, information of a type of sheet and a sheet thickness of each sheet feed cassette 44 that a user inputs by the input unit such as a control panel is obtained from the body controller 110. However, a sensor that detects a sheet thickness and a type of sheet (stiffness of the sheet) may be provided in the apparatus body 100 and the secondary transfer device 21.

As described above, by pressing down the secondary transfer roller 22 further than when a normal secondary transfer pressure is applied to perform a secondary transfer, a posture of the sheet P near the upstream of the secondary transfer nip entrance can be set in a direction away from the intermediate transfer belt 20. Therefore, an abnormal image of a transfer dust and a transfer variation that occurs when the sheet P approaches the intermediate transfer belt 20 can be suppressed. In Embodiment 2, the control of changing the rotation stop position of the cams 75 and 76 when changing the press-down amount can be performed by shifting a press-down operation start timing.

A length at the rear end side of the sheet P pressed down by the secondary transfer roller 22 is a distance portion from the secondary transfer nip to the front side of the upper guide member 92. This is because, as described above, the abnormal image of the transfer dust and the transfer variation occurs due to the approaching of the intermediate transfer belt 20 to the sheet P after the rear end of the sheet P passes through the front end of the upper guide member 92. The press-down operation start timing is determined by the information obtained by processing engine software by the controller. At the press-down operation start timing determined in this way, by matching a target position of the rear end of the sheet P, the penetrating shaft member 16A of the secondary-transfer opposing roller 16 is rotation-operated to rotate the cams 75 and 76 in the counter-clockwise direction. In this way, the rotation operation is once stopped.

Thereafter, after the rear end of the sheet P or the image-forming region G of the sheet P passes through the secondary transfer nipping portion, the cams 75 and 76 are further rotated in the counter-clockwise direction so that the secondary transfer roller 22 is separated from the intermediate transfer belt 20 from the state shown in FIG. 23 to the state shown in FIG. 24. That is, a cam position B (home position) indicated by B of the cams 75 and 76 in FIG. 24 is further rotated in the counter-clockwise direction to be abutted against the idle rollers 22D and 22E of the secondary transfer roller 22. The rotation direction of the cams 75 and 76 is not limited to the counter-clockwise direction, and can be also set in the clockwise direction based on the setting of the shapes (cam line diagram) of the cams 75 and 76.

The press-down operation is performed mainly in a case where the sheet P to be passed through is a cardboard or a case where the sheet P is a stiff type of sheet. On the other hand, in a case where the sheet P to be passed through is not thick in the sheet thickness or in a case where the sheet P is not a stiff type of sheet, the press-down operation is not performed at the timing of the rear end of the sheet P passing through the front end of the upper guide member 92. In such a case, the cams 75 and 76 are rotated to a separation position where the intermediate transfer belt 20 and the secondary transfer roller 22 are separated from each other shown in FIG. 24 from the state that the secondary transfer is performed by applying the normal secondary transfer pressure shown in FIG. 22. Alternatively, when performing the secondary transfer, a normal print state shown in FIG. 22 is maintained.

Also in Embodiment 2, when making the sheet P enter the secondary transfer nipping portion, the moving velocity of moving the secondary transfer roller 22 toward the intermediate transfer belt 20 from the state shown in FIG. 24 to the state shown in FIG. 22 is configured in a similar manner to that in Embodiment 1. For example, when the abutting operation of abutting the secondary transfer roller 22 against the intermediate transfer belt 20 via the sheet P is divided into the contact operation and the pressing operation, the moving velocity of the secondary transfer roller 22 toward the intermediate transfer belt 20 is changed as described with reference to FIG. 6 in Embodiment 1. That is, the cams 75 and 76 are rotated so that the moving velocity in the contact operation of bringing the secondary transfer roller 22 into contact with the intermediate transfer belt 20 via the sheet P becomes slower than the moving velocity in the pressing operation of generating a predetermined nipping pressure by further moving the secondary transfer roller 22 after the contact operation. In the contact operation, the sheet P is made to enter the secondary transfer nipping portion. With this configuration, the impact when making the sheet P enter the secondary transfer nipping portion can be reduced, and image quality reduction such as shock jitter can be suppressed compared to a conventional practice.

Until the rear end of the sheet P passes through the front end of the upper guide member 92, the secondary transfer is performed in the state that the cams 75 and 76 provided in the secondary-transfer opposing roller 16 and the idle rollers 22D and 22E of the secondary transfer roller 22 are separated from each other as shown in FIG. 22. At this time, the secondary transfer roller 22 is in the contact state after the pressing operation shown in FIG. 25. The rotation of the cams 75 and 76 is stopped. Thereafter, following the conveyance of the sheet P, the secondary transfer to the sheet P at the secondary transfer nipping portion is progressed. At the timing of the rear end of the sheet P passing through the front end of the upper guide member, the cams 75 and 76 are rotated from the state in FIG. 22 to the state shown in FIG. 23. Thereafter, the rotation of the cams 75 and 76 is stopped. That is, the rotation of the cams 75 and 76 is stopped at a position where the cams 75 and 76 at the position A are abutted against the idle rollers 22D and 22E of the secondary transfer roller 22.

At this time, the secondary transfer roller 22 is in the contact state against the intermediate transfer belt 20 as shown in FIG. 25. The secondary transfer roller 22 moves to a position of generating a nipping pressure that does not clearly aggravate the secondary transfer. A pushing depth of the secondary transfer roller into the intermediate transfer belt 20 decreases. A rotation-stop state of the cams 75 and 76 (the cam position) is maintained after the rear end of the sheet P passes through the front end of the upper guide member 92 until the rear end of the sheet P or the image-forming region G of the sheet P passes through the secondary transfer nipping portion. Thereafter, after the rear end of the sheet P or the image-forming region G of the sheet P passes through the secondary transfer nipping portion, the cams 75 and 76 are rotated to a position where the cams 75 and 76 are abutted at the cam position B against the idle rollers 22D and 22E of the secondary transfer roller 22 shown in FIG. 24. Then, the rotation is stopped. Then, the next secondary transfer, that is, the image forming, is prepared. Preferably, the gap between the intermediate transfer belt 20 and the secondary transfer roller 22 shown in FIG. 24 is about 1 mm to 3 mm.

With the above configuration, in addition to the reduction effect of shock jitter when the sheet P enters the secondary transfer nipping portion, there is an effect of suppressing the occurrence of a transfer dust and a transfer variation generated due to the approaching of the sheet P to the intermediate transfer belt 20 after the rear end of the sheet P passes through the front end of the upper guide member 92.

The above description is an example, and embodiments of the present invention may have effects in the following aspects.

(Aspect A)

A secondary transfer device such as the secondary transfer device 21 includes an image carrier such as the intermediate transfer belt 20 to carry a toner image, a transfer roller such as the secondary transfer roller 22 to form a transfer nipping portion such as secondary transfer nipping portion in contact with the image carrier and transfer the toner image carried on the image carrier onto a recording medium such as the cardboard P2 entering the transfer nipping portion, and a moving unit configured by, e.g., the roller unit holder 60 and the bias coil spring 65 to move the transfer roller between a state in which the transfer roller forms the transfer nipping portion in contact with the image carrier and a separated state in which the transfer roller is separated from the image carrier. In a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation. The moving unit causes the recording medium to enter the transfer nipping portion in the contact operation.

According to this, Embodiment 1 (or Embodiment 2) can exert the following effects. Because the recording medium is causes to enter the transfer nipping portion in the contact operation of start generating the nipping pressure, a rapid increase in the nipping pressure generated when the cardboard enters can be reduced further than a transfer device that causes the recording medium to enter the transfer nipping portion in a nipping pressure generated state. Therefore, the occurrence of shock jitter when causing the recording medium to enter the transfer nipping portion can be suppressed further than that in a transfer device that causes the recording medium to enter the transfer nipping portion in a nipping pressure generated state.

Even when the sheet conveyance velocity becomes fast, by suppressing the increase in the moving velocity in the contact operation and by increasing the moving velocity in the pressing operation, the transfer roller can be moved to the necessary nipping-pressure position before the image-forming region of the recording medium enters the transfer nipping portion. Therefore, even when the sheet conveyance velocity becomes fast, the moving velocity of the transfer roller toward the intermediate transfer member in the contact operation can be set slower than the moving velocity of the transfer roller which is the same both in the contact operation and the pressing operation in the transfer device, while suppressing image quality reduction attributable to transfer pressure shortage. Therefore, the impact when the recording medium enters the transfer nipping portion can be reduced further than that in a conventional transfer device in which the moving velocity of the transfer roller is the same both in the pressing operation and the contact operation. Consequently, the suppression effect of suppressing image quality reduction such as shock jitter can be further enhanced. Thus, Embodiment 1 (or 2) can provide a transfer device to contact and separate a transfer roller to and from an image carrier which carries a toner image. The transfer device can reduce the impact when causing a recording medium to enter a transfer nipping portion, and can suppress image quality reduction such as shock jitter compared to a conventional practice.

(Aspect B)

In Aspect A, the image carrier is an intermediate transfer member such as the intermediate transfer belt 20. According to this, as described in Embodiment 1 (or Embodiment 2), the effect of Aspect A can be obtained by the transfer device that is used in the intermediate-transfer system image forming apparatus such as the image forming apparatus 500.

(Aspect C)

In Aspect A or Aspect B, the moving unit configured by the roller unit holder 60 and the bias coil spring 65 has a cam such as the first cam 75 or the second cam 76. By the rotation of the cam, the transfer roller such as the secondary transfer roller 22 is moved. According to this, as described in Embodiment 1 (or Embodiment 2), by using the cam as a moving unit of the transfer roller, the transfer roller can be moved in a simple configuration. The cost of the transfer device capable of obtaining the effect of Aspect A can be reduced.

(Aspect D)

In Aspect C, the transfer device includes a secondary-transfer opposing roller such as the secondary-transfer opposing roller 16 disposed opposing the transfer roller such as the secondary transfer roller 22 via the image carrier such as the intermediate transfer belt 20. A rotary shaft such as the penetrating shaft member 16A rotatably supports the secondary-transfer opposing roller and holds the cam such as the first cam 75 or the second cam 76. According to this, as described in Embodiment 1 (or Embodiment 2), the following transfer device can be provided. The transfer device can be made more compact than a configuration in which a member holding the cam to move the secondary transfer roller is provided separately from the rotary shaft of the secondary-transfer opposing roller 16. By reducing the number of parts, the cost of the transfer device can be reduced.

(Aspect E)

In Aspect C or Aspect D, an angular velocity of rotation of the cam such as the first cam 75 or the second cam 76 is constant. A change amount per unit time of a distance from a rotation center of the penetrating shaft member 16A and the like to a portion at which the cam contacts a follower such as the first idle roller 22D or the second idle roller 22E that moves the transfer roller such as the secondary transfer roller 22 is set to be smaller in the contact operation than in the pressing operation. According to this, as described in Embodiment 1 (or Embodiment 2), by changing the cam radius of the cam for making the angular velocity of rotation constant, the moving velocity of the transfer roller toward the intermediate transfer member can be changed between the pressing operation and the contact operation. Therefore, it becomes possible to rotation-drive the cam by using the driving source which is the same as that of the driving unit of the image carrier such as the intermediate transfer belt 20 and the like. Consequently, it becomes possible to make compact the image forming apparatus such as the image forming apparatus 500 and reduce cost by decreasing the exclusive driving source of the cam driving motor 79 and the like.

(Aspect F)

In Aspect C or Aspect D, the moving unit configured by the roller unit holder 60, the bias coil spring 65, and the like has a motor such as the cam driving motor 79 formed of a stepping motor to rotate the cam such as the first eccentric cam 85 or the second eccentric cam 86. The motor rotates the cam in the contact operation at an angular velocity slower than in the pressing operation. According to this, as described in Embodiment 1 (or Embodiment 2), the following transfer device can be provided. By using a motor such as a stepping motor, it becomes possible to highly-accurately control a rotation position of rotating the cam and an angular velocity of rotation, highly-accurately control a change amount per unit time of the radius of the cam that is brought into contact with the follower, and highly-accurately control the moving velocity of a secondary transfer roller such as the secondary transfer roller 22. Therefore, the moving velocity of a targeted secondary transfer roller can be easily obtained. Since the moving velocity of a targeted secondary transfer roller can be easily obtained, the cost of the cams can be also reduced by using cams having a simple shape such as eccentric cams.

(Aspect G)

In any one of Aspect A to Aspect F, the moving unit configured by the roller unit holder 60, the bias coil spring 65, and the like moves the transfer roller such as the secondary transfer roller 22 in the contact operation at a moving velocity slower than that in other operation such as an approaching operation and a pressing operation of moving the transfer roller toward the image carrier such as the intermediate transfer belt 20. According to this, as described in Embodiment 1 (or Embodiment 2), the following transfer device can be provided. In the abutting operation of generating a predetermined nipping pressure by abutting the transfer roller against the image carrier, by setting the moving velocity slow only in the contact operation, the influence to the transfer roller can be made small. Therefore, a transfer device that achieves higher image quality and a higher velocity can be provided.

(Aspect H)

In any one of Aspect D to Aspect G, the transfer device includes a guide member such as the upper guide member 92 to guide the recording medium when causing the recording medium such as the sheet P to enter into between the intermediate transfer member such as the intermediate transfer belt 20 and the transfer roller such as the secondary transfer roller 22. The moving unit configured by the roller unit holder 60 and the bias coil spring 65 performs a press-down operation of changing a rotation position of the cam such as the first cam 75 or the second cam 76 to increase a distance between a rotary shaft such as the penetrating shaft member 16A of the secondary-transfer opposing roller such as the secondary transfer roller 16 and a rotary shaft of the first shaft member 22B and the second shaft member 22C of the transfer roller at a timing of a rear end of the recording medium passing a downstream end of the guide member in a recording medium conveyance direction such as a sheet conveyance direction. According to this, as described in Embodiment 2, the posture on the upstream side of the transfer nipping portion of the recording medium that passed through the downstream end of the guide member in the recording medium conveyance direction can be changed to a direction away from the intermediate transfer member. Accordingly, it is possible to provide a transfer device such as the secondary transfer device 21 that can suppress an abnormal image such as a transfer dust and a transfer variation generated due to the approaching of the image carrier to the recording medium near the entrance of the transfer nip.

(Aspect I)

In Aspect H, the transfer device includes a controller to determine whether the moving unit is to perform the press-down operation according to one or both of type and thickness of the recording medium such as the sheet P. According to this, as described in Embodiment 2, it is possible to provide a transfer device such as the secondary transfer device 21 that can perform the press-down operation based on only type and thickness having a possibility of occurrence of a transfer dust and a transfer variation and that can efficiently suppress an abnormal image such as a transfer dust and a transfer variation.

(Aspect J)

In Aspect H or Aspect I, the transfer device includes a recording-medium information obtainer such as a sheet information obtainer 121 that obtains information of a thickness of the recording medium such as the sheet P. When the recording-medium information obtainer obtains information that a thickness of a recording medium is a predetermined thickness or more, the moving unit performs the press-down operation. According to this, as described in Embodiment 2, the press-down operation is performed to only a cardboard in which the transfer dust and the transfer variation occur. Consequently, an abnormal image can be easily suppressed.

(Aspect K)

In any one of Aspect H to Aspect J, the transfer device changes an amount of increasing a distance between an axial center of a rotary shaft such as the penetrating shaft member 16A of the secondary-transfer opposing roller 16 and an axial center of a rotary shaft such as the first shaft member 22B and the second shaft member 22C of the transfer roller such as the secondary transfer roller 22 by changing a rotation position of the cam such as the first cam 75 or the second cam 76, according to one or both of type and thickness of the recording medium such as the sheet P. According to this, as described in Embodiment 2, an abnormal image can be suppressed efficiently under an optimum condition, without changing a press-down amount according to type and thickness of the recording medium.

(Aspect L)

An image forming apparatus such as the image forming apparatus 500 that includes an image carrier such as the intermediate transfer belt 20 that carries a toner image, a transfer roller such as the secondary transfer roller 22, and a moving unit configured by the roller unit holder 60 and the bias coil spring 65 that moves the transfer roller between a state of forming the transfer nipping portion such as a secondary transfer nipping portion by being abutted against the image carrier and a separated state. The image forming apparatus includes a transfer device such as the secondary transfer device 21 according to any one of Aspect A to Aspect K, as the transfer device. According to this, as described in Embodiment 1 (or Embodiment 2), it is possible to provide an image forming apparatus that can exert a similar effect to that of the transfer device according to any one of Aspect A to Aspect K.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A transfer device, comprising:

an image carrier to carry a toner image thereon;

a transfer roller to form a transfer nipping portion in contact with the image carrier and transfer the toner image carried on the image carrier onto a recording medium entering the transfer nipping portion; and a moving unit to move the transfer roller between a nip formation state in which the transfer roller forms the transfer nipping portion in contact with the image carrier and a separated state in which the transfer roller is separated from the image carrier, wherein in a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation, and the recording medium enters the transfer nipping portion in the contact operation.

2. The transfer device according to claim 1, wherein the image carrier is an intermediate transfer member.

3. The transfer device according to claim 1, wherein the moving unit includes a cam and moves the transfer roller by rotation of the cam.

4. The transfer device according to claim 3, further comprising:

a secondary-transfer opposing roller disposed opposing the transfer roller via the image carrier; and a rotary shaft to rotatably support the secondary-transfer opposing roller and hold the cam.

5. The transfer device according to claim 3, wherein an angular velocity of rotation of the cam is constant, and a change amount per unit time of a distance from a rotation center of the cam to a portion at which the cam contacts a follower that moves the transfer roller is smaller in the contact operation than that in the pressing operation.

6. The transfer device according to claim 3, wherein the moving unit includes a motor to rotate the cam in the contact operation at an angular velocity slower than that in the pressing operation.

7. The transfer device according to claim 1, wherein the moving unit moves the transfer roller in the contact operation at a moving velocity slower than that in an approaching operation of moving the transfer roller toward the image carrier that is different from the contact operation.

8. The transfer device according to claim 4, further comprising a guide member to guide the recording medium into between the image carrier and the transfer roller, wherein the moving unit performs a press-down operation of changing a rotation position of the cam to increase a distance between a rotary shaft of the secondary-transfer opposing roller and a rotary shaft of the transfer roller when a rear end of the recording medium passing a downstream end of the guide member in a conveyance direction of the recording medium.

9. The transfer device according to claim 8, further comprising a controller to determine whether the moving unit is to perform the press-down operation according to one or both of type and thickness of the recording medium.

10. The transfer device according to claim 8, further comprising a recording-medium information obtainer to obtain information on a thickness of the recording medium, wherein, when the recording-medium information obtainer obtains information that the thickness of the recording medium is a predetermined thickness or more, the transfer device performs the press-down operation.

11. The transfer device according to claim 8, wherein the transfer device changes an amount of increasing a distance between an axial center of the rotary shaft of the secondary-transfer opposing roller and an axial center of the rotary shaft of the transfer roller by changing the rotation position of the cam, according to one or both of type and thickness of the recording medium.

12. The transfer device according to claim 1, wherein the contact operation starts before a leading edge of the recording medium enters the transfer nipping portion.

13. The transfer device according to claim 1, wherein the contact operation ends after a leading edge of the recording medium enters the transfer nipping portion.

14. The transfer device according to claim 1, wherein the pressing operation starts after a leading edge of the recording medium enters the transfer nipping portion.

15. The transfer device according to claim 1, wherein the pressing operation starts before an image forming region of the recording medium enters the transfer nipping portion.

16. The transfer device according to claim 1, wherein the pressing operation ends after an image forming region of the recording medium enters the transfer nipping portion.

17. An image forming apparatus comprising a transfer device, the transfer device including an image carrier to carry a toner image thereon;

a transfer roller to form a transfer nipping portion in contact with the image carrier and transfer the toner image carried on the image carrier onto a recording medium entering the transfer nipping portion; and a moving unit to move the transfer roller between a nip formation state in which the transfer roller forms the transfer nipping portion in contact with the image carrier and a separated state in which the transfer roller is separated from the image carrier, wherein in a contact operation of bringing the transfer roller into contact with the image carrier via the recording medium, the moving unit moves the transfer roller toward the image carrier at a moving velocity slower than that in a pressing operation of generating a predetermined nipping pressure by further moving the transfer roller toward the image carrier after the contact operation, and the recording medium enters the transfer nipping portion in the contact operation.

* * * * *